US006099179A

United States Patent [19]

Higashi et al.

[11] Patent Number: 6,099,179

[45] Date of Patent: Aug. 8, 2000

[54] IMAGE RECORDING DEVICE HAVING A CASSETTE THAT PIVOTS FEED ROLLERS INTO NIPPING POSITION

[75] Inventors: Takashi Higashi, Nagoya; Yasuhiro Shibata, Okazaki; Koshiro Yamaguchi, Kasugai; Kiyoshi Sugimoto, Kuwana, all of Japan

[73] Assignee: Brother Kogyo Kabushiki Kaisha, Nagoya, Japan

[21] Appl. No.: 09/172,007

[22] Filed: Oct. 14, 1998

[30] Foreign Application Priority Data

Oct. 17, 1997 [JP] Japan ..... 9-285753

[51] Int. Cl.[7] ..... B41J 15/04

[52] U.S. Cl. ..... 400/613; 400/611; 400/624; 400/625; 400/629; 271/162

[58] Field of Search ..... 242/564.4, 563; 400/611, 613, 619, 624, 625, 629; 271/162

[56] References Cited

U.S. PATENT DOCUMENTS

| | | | |
|---|---|---|---|
| 3,861,610 | 1/1975 | Landis | 242/564.1 |
| 4,387,889 | 6/1983 | Koyama et al. | 271/10.01 |
| 4,566,785 | 1/1986 | Takenouchi | 355/72 |
| 4,854,519 | 8/1989 | Maeda et al. | 242/422.4 |
| 5,020,788 | 6/1991 | Hatano et al. | 271/126 |
| 5,232,297 | 8/1993 | Kitazawa | 400/621 |

FOREIGN PATENT DOCUMENTS

| | | | |
|---|---|---|---|
| 0 872 352 A1 | 10/1988 | European Pat. Off. . | |
| 0 872 353 A1 | 10/1988 | European Pat. Off. . | |
| A-62-271771 | 11/1987 | Japan . | |
| 4-163069 | 6/1992 | Japan | 400/613 |
| A-5-84994 | 4/1993 | Japan . | |
| A-8-233675 | 9/1996 | Japan . | |

OTHER PUBLICATIONS

"Roll Cartridge Document feeder for Automatic Teller Machine," IBM Technical Disclosure Bulletin, vol. 31, No. 5 Oct. 1988.

*Primary Examiner*—John S. Hilten
*Assistant Examiner*—Daniel J. Colilla
*Attorney, Agent, or Firm*—Oliff & Berridge, PLC

[57] ABSTRACT

An image recording device having a detachable web roll cassette in which a rolled web sheet is accommodated. The device includes a frame body having a web roll cassette insertion port, a web roll cassette accommodating portion, and a web sheet passage extending from the web roll cassette accommodating portion in a sheet feeding direction. The device also includes a sheet feeding unit including a drive roller and a pinch roller for nipping the web sheet therebetween, and a print head for printing the image on the web sheet fed by the sheet feed unit. A pivot mechanism is provided to move the front end discharge portion of the web roll cassette toward an operating position. The pivot mechanism is also provided with the drive roller for moving the drive roller toward the sheet nipping position when the front end discharge portion is moved to the operating position. A regulation mechanism is provided to prevent the pivot mechanism from being operated if the web roll cassette is not inserted or if the web roll cassette has not moved to a predetermined position in the web roll cassette accommodating portion.

24 Claims, 15 Drawing Sheets

IMAGE RECORDING DEVICE HAVING A CASSETTE THAT PIVOTS FEED ROLLERS INTO NIPPING POSITION

BACKGROUND OF THE INVENTION

The present application is closely related to commonly assigned copending U.S. patent application Ser. No. 09/058,276 filed Apr. 10, 1998, and Ser. No. 09/058,356 filed Apr. 10, 1998.

The present invention relates to an image recording device such as a thermal head printer which detachably installs a web roll cassette in which a rolled image recording medium or a web roll is accommodated.

A conventional image recording device that has become of practical use is a tape-shaped label printing device described in U.S. Pat. No. 5,232,297 and Japanese Patent-Application Publication (Kokai) No. HEI-8-233675. The conventional device includes a recording device having a frame body, a keyboard, a display, and a thermal printing type recording mechanism, and a label cassette housing a recording tape and an ink ribbon. The label cassette is interchangeably mounted in a cassette accommodating section of the recording device. A thermal head prints on the recording tape via the ink ribbon, according to text characters and symbols input from the keyboard. The printed labels are appropriate for adhering to the spines of files and the like.

Conventionally, the recording tape used in these recording devices has been relatively narrow, that is, about 6–24 millimeters. Recently, however, wider recording tape is also in demand for use in signboards, as those used in giving directions or stating prices.

For this reason, the inventors of the present invention proposed a recording device construction as described in the above two copending U.S. patent applications. The copending applications disclose an image recording device having a detachable web roll cassette in which a rolled web sheet is accommodated. The device includes a frame body having a web roll cassette insertion port, a web roll cassette accommodating portion, and a web sheet passage extending from the web roll cassette accommodating portion in a sheet feeding direction. The device also includes a web roll cassette, a sheet feeding unit including a drive roller and a pinch roller for nipping the web sheet therebetween, and a print head for printing the image on the web sheet fed by the sheet feed unit. The web roll cassette includes an upper and lower cases accommodating therein a web roll at one side and defining a front end discharge portion at another side directing toward the web sheet passage. The upper and lower cases are formed with through holes at a position adjacent the front end discharge portion. The drive roller and the pinch roller are respectively positioned at the through holes.

The drive roller and the pinch roller are movable toward and away from the web sheet to perform selective contact therewith. To this effect, a pivot mechanism is provided to move the front end discharge portion of the web roll cassette toward a proper printing position. The drive roller is provided to the pivot mechanism, so that the drive roller is moved toward the pinch roller when the web roll cassette is set to its printing posture. When the web roll cassette is moved to its correct printing posture, the drive roller and the pinch roller nip therebetween the web sheet at the front end discharge portion of the web roll cassette.

SUMMARY OF THE INVENTION

With this arrangement, however, if the pivot mechanism is manipulated in a state where the web roll cassette has not been inserted into the web roll cassette accommodating portion, the drive roller is moved to the web sheet nipping position. With this state, if the web roll cassette is inserted into the web roll cassette accommodating portion, the front end discharge portion of the web roll cassette abuts or collides the pinch roller and the drive roller. Consequently, the front end discharge portion and/or the drive roller and the pinch roller may be broken.

It is therefore, an object of the present invention to provide an image forming device capable of preventing the feed unit from being unintentionally moved to the web sheet feeding position if the web roll cassette has not yet been inserted into the web roll cassette accommodating portion.

This and other objects of the present invention will be attained by an image recording device for forming an image on a sheet, the sheet being accommodated in a cassette and discharged from a front end discharge portion of the cassette, the image recording device including a frame body, a sheet feed unit, a printing unit, a pivot mechanism, and a regulation mechanism. The frame body is provided with a cassette insertion port, a cassette accommodating portion, and a sheet passage extending from the cassette accommodating portion in a sheet feeding direction. The cassette is detachably mounted in the cassette accommodating portion through the cassette insertion port. The cassette accommodating portion has a guide member that guides the cassette in a predetermined orientation. The sheet feed unit nips the sheet at the front end discharge portion and feeds the sheet in the sheet feeding direction along the sheet passage. The sheet feed unit includes a drive roller and a pinch roller for nipping therebetween the sheet. The printing unit prints the image on the sheet fed by the sheet feed unit. The pivot mechanism includes a lever and a support portion. The lever is movable between a nipping position where the drive roller and the pinch roller are relatively moved toward each other for nipping the sheet and a release position where the drive roller and the pinch roller are relatively moved away from each other. The support portion is pivotally movable upon pivotal movement of the lever. One of the drive roller and the pinch roller is supported to the support portion and remaining one of the pinch roller and the drive roller is supported on the frame body. The regulation mechanism prevents the lever from pivotally moved toward the nipping position until the front end discharge portion reaches a predetermined position in accordance with the insertion of the cassette relative to the guide member.

In another aspect of the invention, there is provided an image recording device for forming an image on a web sheet unwound from a web roll, the device including a frame body, a sheet feed unit, a printing unit, a front guide projection, a rear guide projection, a pivot mechanism, a web roll cassette, and a regulation mechanism. The frame body is formed with a cassette insertion port, a cassette accommodating portion, and a feed passage positioned downstream of the cassette accommodating portion. The sheet feed unit is adapted for feeding the web sheet along the feed passage in a feeding direction. The sheet feed unit feeds the web sheet in the sheet feeding direction along the web sheet passage. The sheet feed unit includes a drive roller and a pinch roller for nipping therebetween the web sheet. The printing unit is adapted for printing an image on the web sheet. The front guide projection protrudes from the cassette accommodating portion. The rear guide projection protrudes from the cassette accommodating portion and at a position higher than the front guide projection. The pivot mechanism is adapted for pivotally moving the web roll cassette between an operating position in horizontal alignment with the rear guide projection and a slanted inserting position. The pivot mechanism includes a lever movable between a nipping position where the drive roller and the pinch roller are relatively moved toward each other for nipping the web sheet and a release position where the drive roller and the pinch roller are relatively moved away from each other, and a support portion pivotally movable upon pivotal movement of the lever. One of the drive roller and the pinch roller is supported to the support portion and remaining one of the pinch roller and the drive roller is supported on the frame body. The web roll cassette houses therein the web roll serving as an image recording medium. The web roll cassette includes a lower case, an upper case, and a platen. The lower case has one side and another side. The upper case is supported on the lower case and has one side and another side. The upper and lower cases selectively provide an opening state and a closing state and define therein an accommodation space at the one side for accommodating therein the web roll in the closing state. A front end discharge portion is formed at the another side of the upper and lower cases in the closing state. The front end discharge portion is engageable with the pivot mechanism, and, the sheet feed unit nips the web sheet at the front end discharge portion. The platen is provided at a position upstream of the front discharge portion in the feeding direction. The platen is confrontable with the printing unit. Through holes are formed in the upper and lower cases at a position between the front discharge portion and the platen for allowing the feeding unit to be positioned in the through holes. A guide groove is formed at a lateral side of the lower case for engaging with the front and rear guide projections. The regulation mechanism prevents the lever from pivotally moved toward the nipping position until the front end discharge portion reaches a predetermined position in accordance with the insertion of the web roll cassette relative to the guide member.

BRIEF DESCRIPTION OF THE DRAWINGS

In the drawings:

FIG. 12(*b*) is a partial perspective view showing the shutter in a closed state according to the embodiment;

FIG. 13(*b*) is an enlarged side cross-sectional view showing the relative parts of the shutter in an open state;

DETAILED DESCRIPTION OF THE PREFERRED EMBODIMENTS

A web roll and a web roll cassette according to a preferred embodiment of the present invention will be described while referring to the accompanying drawings.

Figure 1:
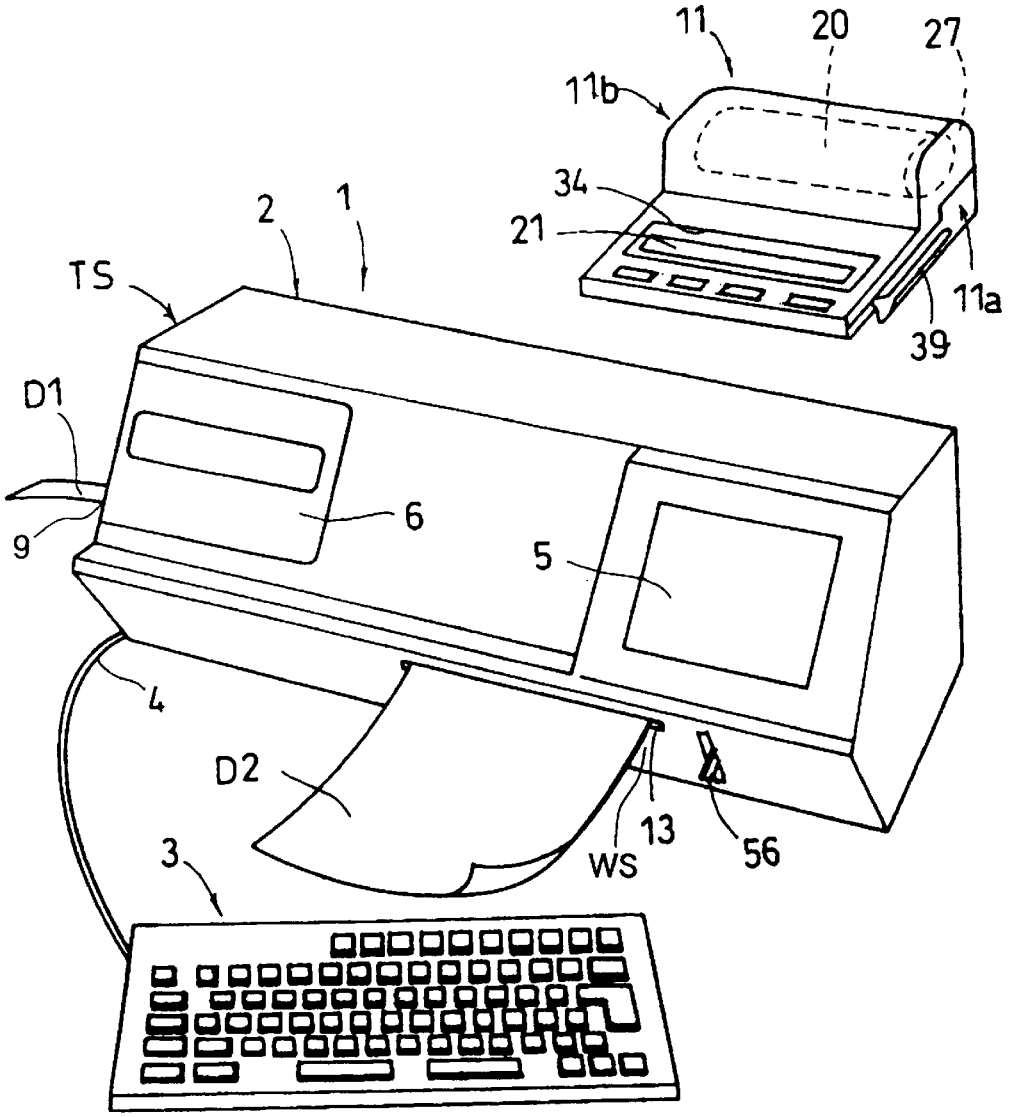
FIG. 1 is a perspective view showing a tape printing device and a web roll cassette according to a preferred embodiment of the present invention.

First, a recording device and a general arrangement of a web roll cassette according to the present embodiment will be described with reference to FIGS. 1 and 2. The recording device is a tape printer 1 for printing various characters and symbols, including alphabet, hiragana, kanji, and the like, on a wide or a narrow recording medium, such as a recording tape. The printer 1 includes a frame body 2 which houses two stations, a tape station TS and a wide station WS. The tape station TS is provided to record on a first recording medium, which is a narrow recording medium D1. The wide station WS is provided to record on a second recording medium, which is a wide recording medium or a web sheet D2.

A keyboard 3 is provided with character and symbol keys, such as a new line key, character keys, and function keys, such as an execute key. A cable 4 connects the keyboard 3 to the printer 1. Various data and command signals are transmitted from the keyboard 3 via the cable 4 to a control unit (not shown) provided in the printer 1. A display 5 such as a liquid crystal display is provided on the right portion of the frame body 2 shown in FIG. 1 for displaying characters and the like inputted from the keyboard 3, as well as various instructions.

A cover member 6 is disposed on the left portion of the frame body 2 and can be opened and closed. Opening the cover member 6 reveals the tape station TS. A discharge opening 13 is formed in a front wall of the frame body 2 for discharging a printed wide web sheet D2. Another discharge port 9 is formed in the left end of the frame body 2 for discharging the narrow recording medium D1. Further, a lever 56 is accessibly provided in the front wall of the frame body 2 so as to change posture of a web roll cassette 11 when the cassette 11 is installed in the frame body 2 as described later.

The web roll cassette 11 is detachably mounted in the wide station WS. The web roll cassette 11 is mounted through an insertion port 12 (FIG. 2), which serves as the mounting portion in the rear of the frame body 2. The wide web sheet D2, which is wound into a roll shape (hereinafter referred to as a web roll 20), is contained within the web roll cassette 11. The web roll cassette 11 includes a lower case 11*a* and an upper case 11*b*, both of which are formed of synthetic resin material through an injection molding process. The upper case 11*b* provides an accommodation space 27 for accommodating therein the web roll 20. A flat plate-shaped platen 21 is exposed on the top surface near the front end (or discharge portion) of the web roll cassette 11. A rectangular shaped opening 34 is formed in the upper case 11*b* for exposing the top of the platen 21. The lower case 11*a* has side walls at which guide grooves 39 are formed for guiding insertion of the web roll cassette 11 into the frame body 2.

Figure 2:
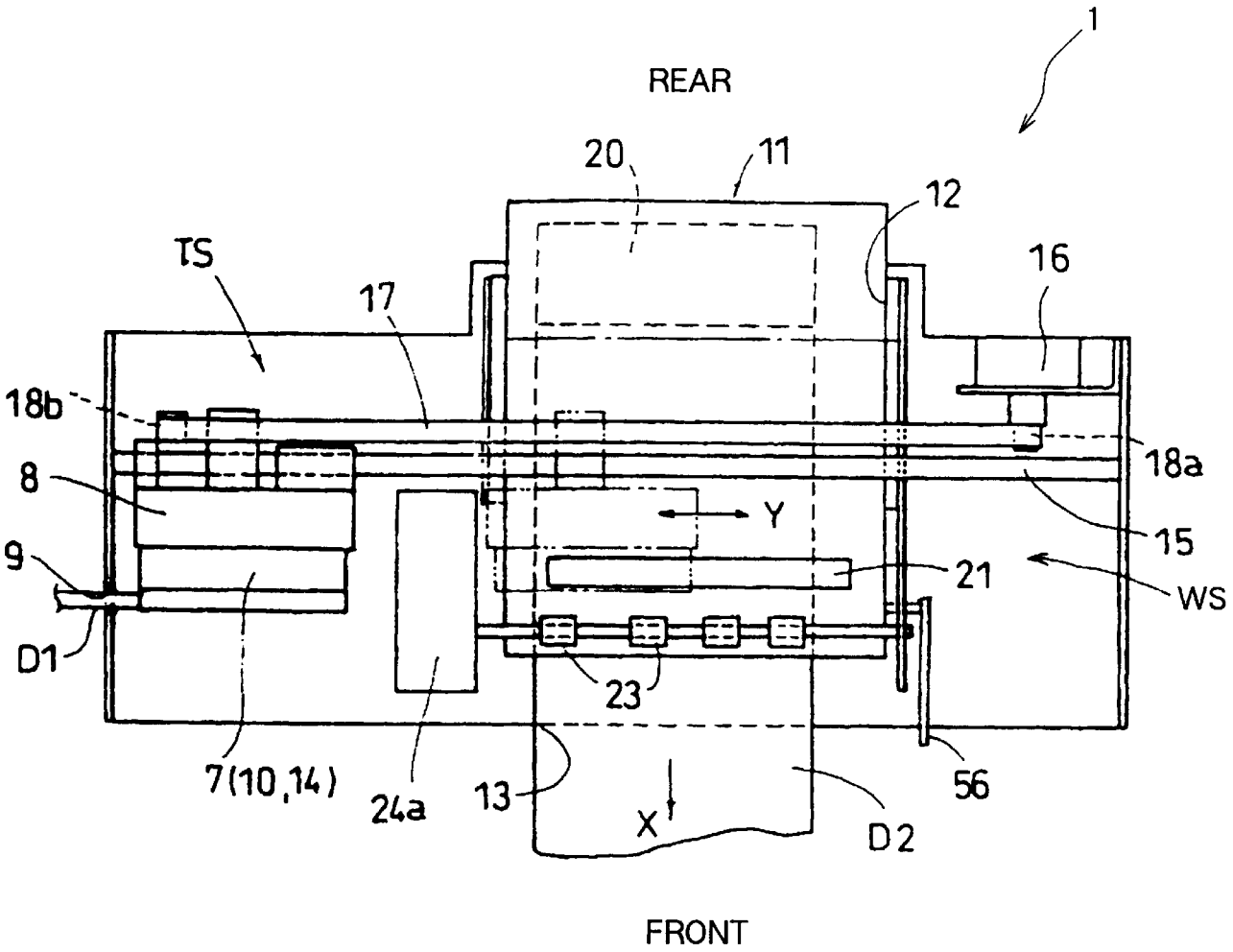
FIG. 2 is a plan view showing a general structure of the tape printing device according to the embodiment.

As shown in FIG. 2, the tape station TS includes a carriage 8, a tape cassette 7 mounted in the carriage 8 and housing therein the narrow recording medium D1 and an ink ribbon, a thermal head 10 disposed on the carriage 8 as the printing unit, a platen roller (not shown) provided movably toward and away from the thermal head 10 for selective contact therewith, the discharge port 9, and a cutting device (not shown in FIG. 2) disposed near the discharge port 9. The platen 21 is positioned in opposition to the thermal head 10. The recording medium D1 and the ink ribbon are conveyed between the thermal head 10 and the platen roller during the printing operation. The conveyed ink ribbon is wound up in the tape cassette 7, and the printed recording medium D1 is discharged from the discharge port 9. At this time, the cutting device can be used to cut the recording medium D1 to a desirable length.

The carriage 8, which supports the thermal head 10 is movably supported on a guide shaft 15 extending in the Y direction, i.e., a widthwise direction of the web roll 20. A drive pulley 18*a* and a driven pulley 18*b* are disposed one near either end of the guide shaft 15. A timing belt 17 is wrapped around the drive pulley 18*a* and the driven pulley 18*b*. One portion of the timing belt 17 is attached to the carriage 8. A stepper motor 16 is provided for driving the drive pulley 18*a* in order to move the carriage 8 back and forth in the Y direction.

A feed mechanism 24*a* including a drive motor (not shown), gears (not shown), and the like is provided in the frame body 2 for feeding the web roll 20 in an X direction, i.e., frontward direction. Further, a plurality of pinch rollers 23 are rotatably disposed at a position above the web roll 20. As described above, the insertion port 12 is provided at the rear side of the frame body 2, and the lever 56 pivotally extends frontwardly at the front wall of the frame body 2. In addition, a rotary type cutter 81 (FIG. 13(*a*)) is disposed near the discharge opening 13 for cutting the web sheet D2 in the Y direction.

In order to print on the web sheet D2 in a serial recording mode, a ribbon cassette 14 is installed on the carriage 8 instead of the tape cassette 7. The ribbon cassette 14 houses therein a single or multiple color ink ribbon. The web sheet D2 is conveyed in the X direction from the end of the web roll cassette 11 toward the discharge opening 13, while the thermal head 10 moves in the Y direction orthogonal to the web sheet D2 and prints on the web sheet D2. By opening the cover member 6, the ribbon cassette 14 can be freely and interchangeably mounted on the carriage 8.

A drive roller 22 (FIGS. 4 and 5), which is the main paper conveying roller is positioned on the lower side of the front end discharge portion of the web roll cassette 11 via a pivot mechanism 24*b* (FIGS. 3 and 4) described later. The pinch rollers 23 are fixedly disposed at a position above the drive roller 22. The drive roller 22 is driven to rotate by the feed mechanism 24*a*.

Figure 3:
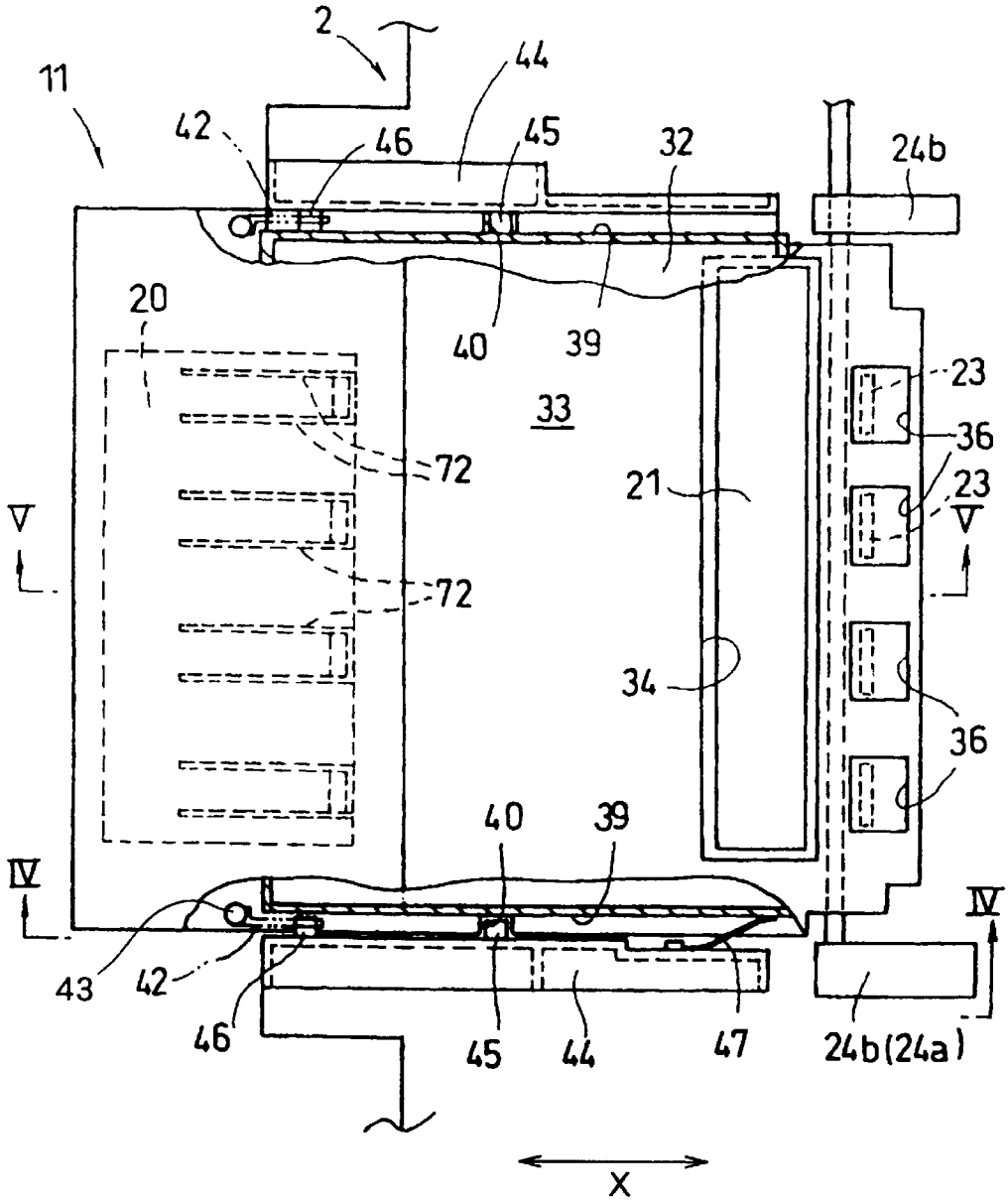
FIG. 3 is a partial plan view showing a mounting portion of a web roll cassette according to the embodiment.
Figure 4:
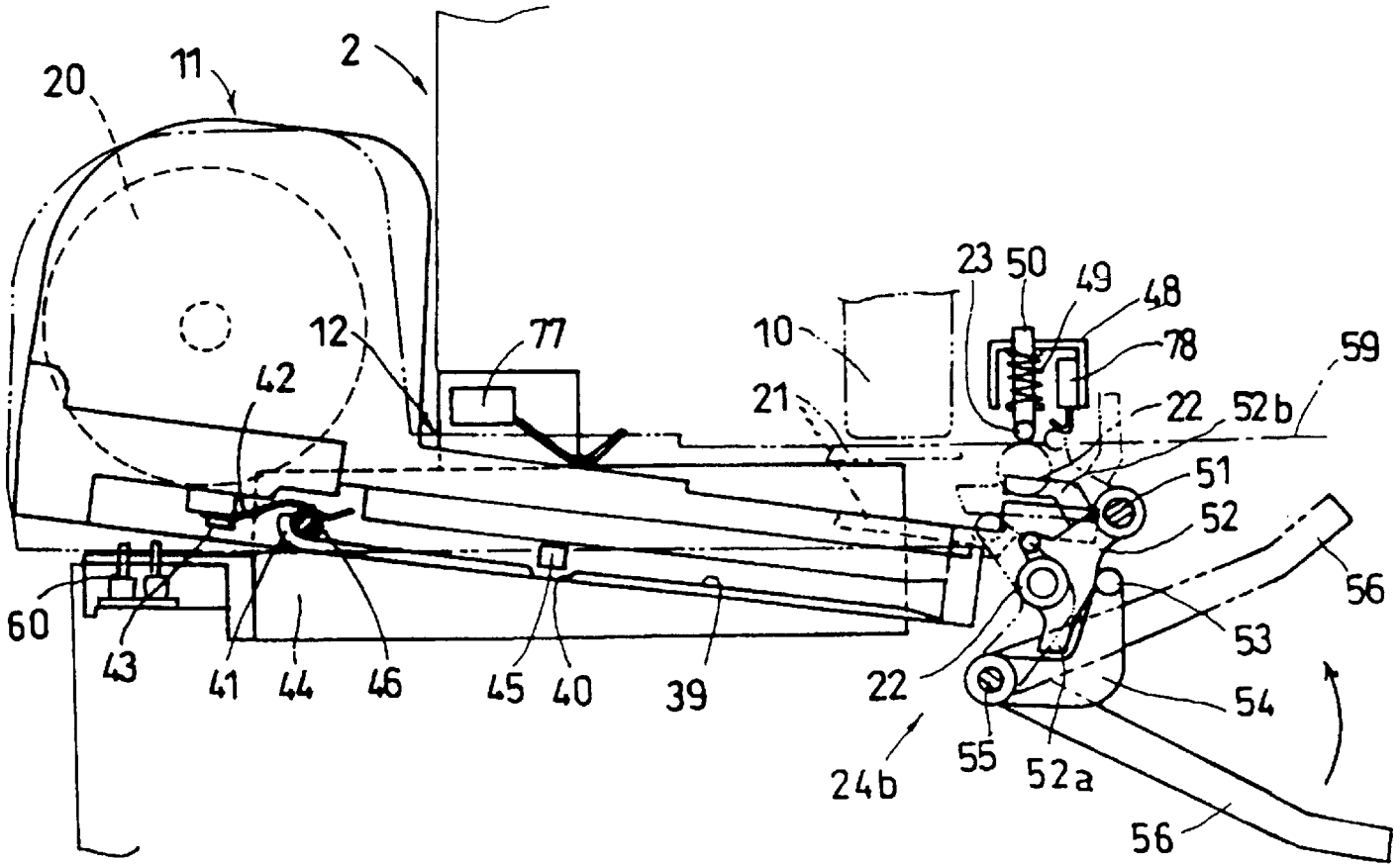
FIG. 4 is a partial cross-sectional side view as viewed from a direction indicated by arrows IV in FIG. 3.

As shown in FIGS. 3 and 4, guide frames 44 are fixed on the left and right sides of the insertion port 12 extending in the insertion direction of the web roll cassette 11 and are disposed so as to provide sliding contact with the left and right sides of the web roll cassette 11. Front guide projections 45 are disposed on the guide frame 44 toward the web roll cassette 11. Cylindrical and horizontally extending rear guide projections 46 are also disposed on the guide frame 44 and are positioned at an appropriate distance behind the front guide projections 45 in the insertion direction of the web roll cassette 11 and at positions higher than the front guide projections 45. The pairs of front guide projections 45 and rear guide projections 46 can be slid into the left and right guide grooves 39 of the web roll cassette 11.

Next, the structure of the web roll cassette 11 will be described with reference to FIGS. 3–11. As best shown in FIG. 8, the lower case 11*a* includes support portions 25 and 26 for freely and rotatably supporting the left and right ends of the web roll 20. The lower case 11*a* also includes side guide plates 29 and 30 for guiding the left and right edges of the web sheet D2 drawn from the web roll 20, and a nose portion 32. The nose portion 32 is provided with the platen 21 and a tray (described later) 31 for guiding the lower surface of cut sheets such as postcards. A through-hole 35 penetrates the front portion of the nose portion 32 and is formed in a long rectangular shape when seen in a plan view. The through-hole 35 allows a part of the drive roller 22 to be protruded therefrom as shown in FIG. 5.

Figure 5:
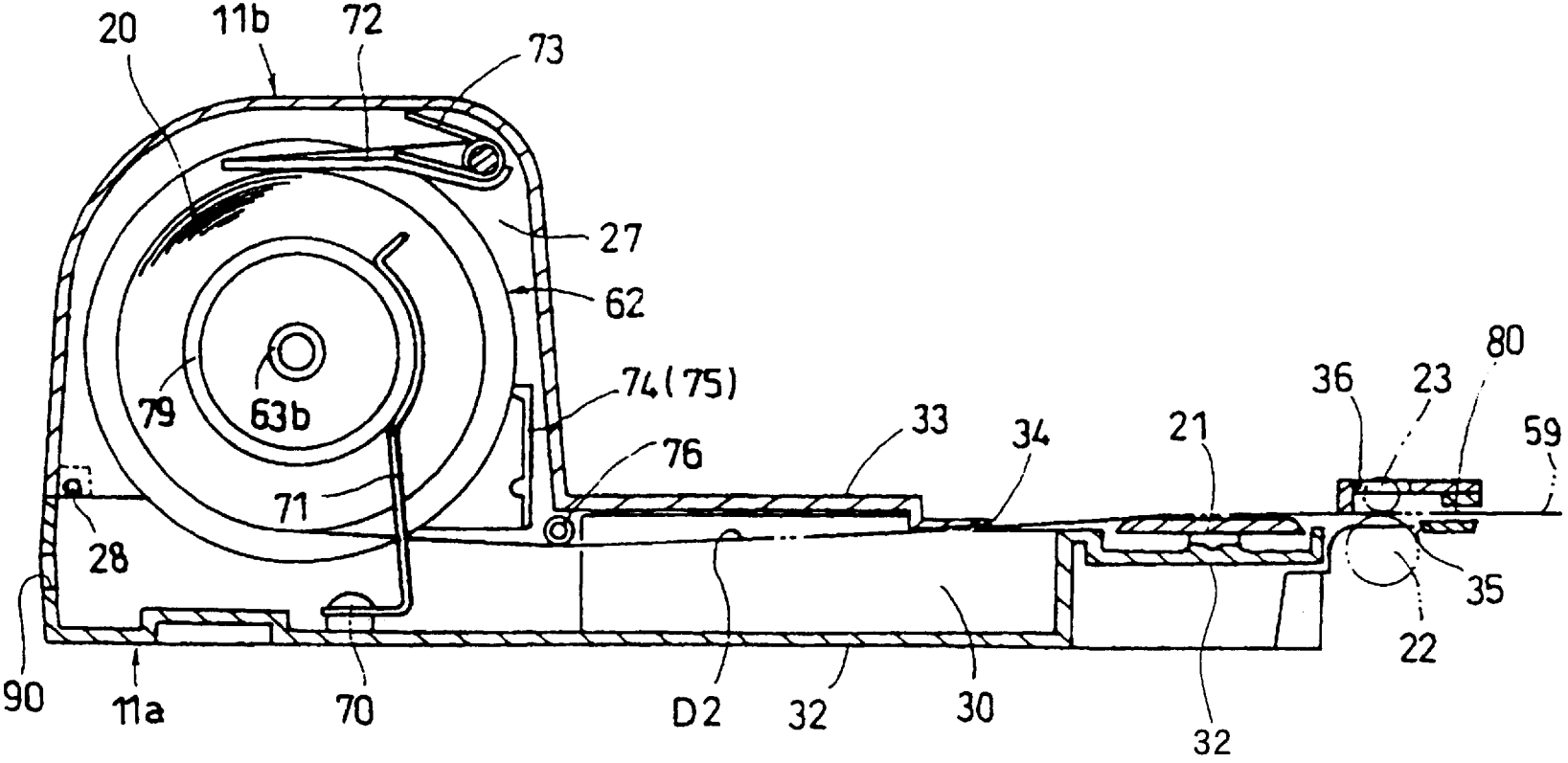
FIG. 5 is a cross-sectional view taken along the line V—V in FIG. 3.

As shown in FIGS. 3 and 5, the upper case 11*b* includes a flat portion 33 extending from the front of the accommodation space 27 for covering the side guide plates 29, 30, and tray 31 of the lower case 11*a*. The opening 34 is formed in the top wall of the upper case 11*b*. Through-holes 36 are formed in the flat portion 33 above the through-hole 35. The pinch rollers 23 can be seen from the top side of these through-holes 36 (FIG. 5).

Figure 6:
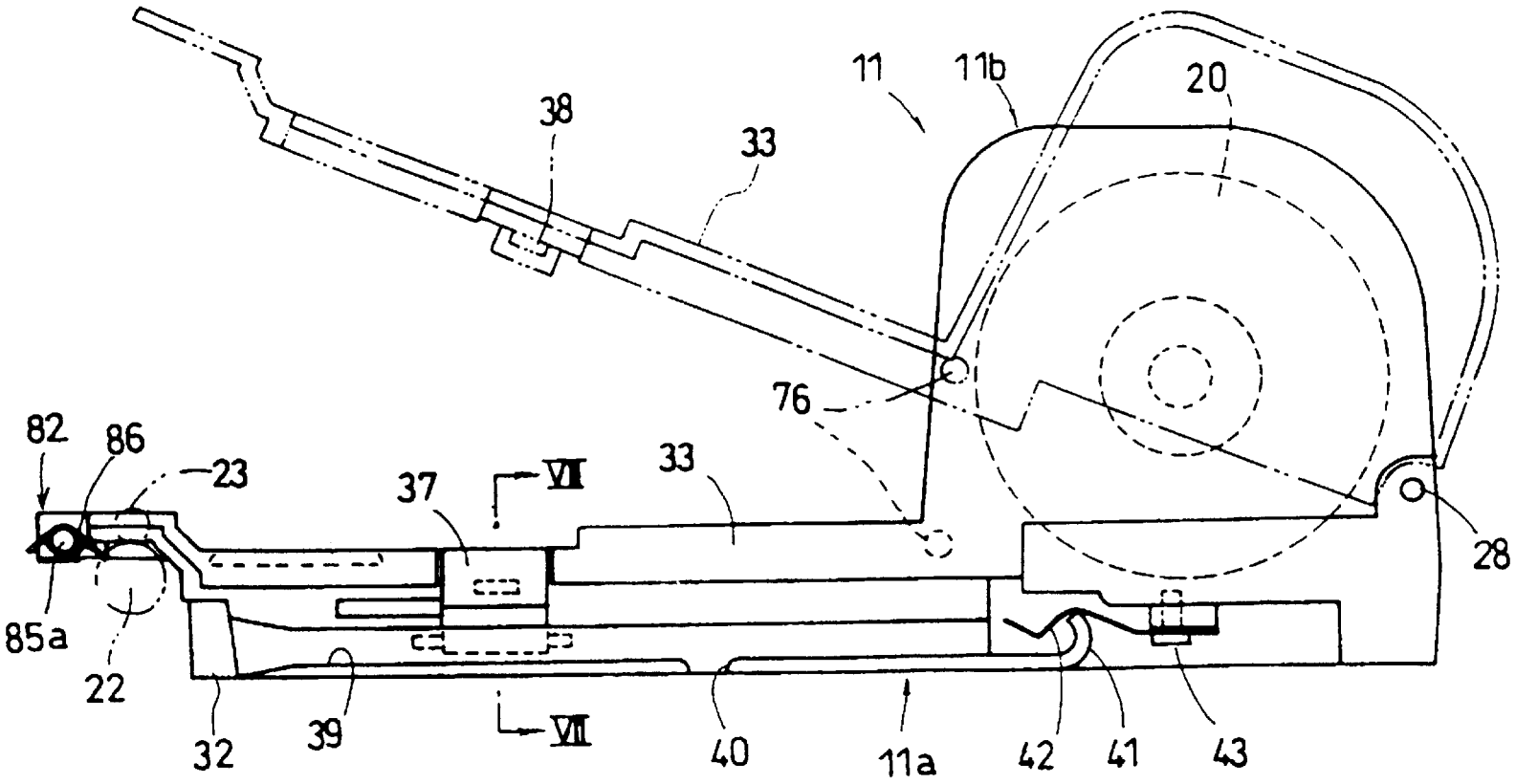
FIG. 6 is a side view of the web roll cassette according to the embodiment.

The upper case 11*b* is pivotably mounted on the lower case 11*a* via a pivot shaft 28 and can open and close by pivoting on this pivot shaft 28 (see FIG. 6). The pivot shaft 28 is positioned opposite the front end discharge portion and adjacent the accommodation space 27. This pivot position is advantageous because an area adjacent the web roll accommodation space 27 has a rigidity higher than that at the front end discharge portion where the opening 34, and the through holes 35, 36 are formed. The web roll cassette 11 is inserted into the frame body 2 via the insertion port 12 when the flat portion 33 is closed against the nose portion 32. When the nose portion 32 and flat portion 33 are closed together, as shown in FIG. 5, a passage 80 is formed between the front ends of the nose portion 32 and the flat portion 33 through which the web sheet D2 can be discharged.

Figure 7:
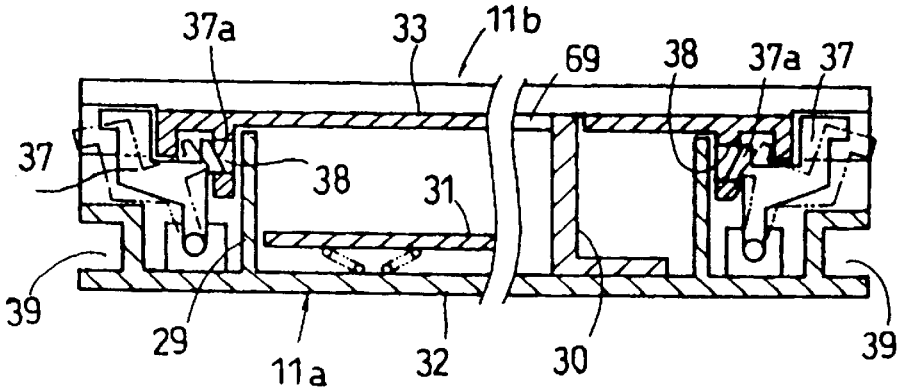
FIG. 7 is a cross-sectional view taken along the line VII—VII in FIG. 6.
Figure 8:
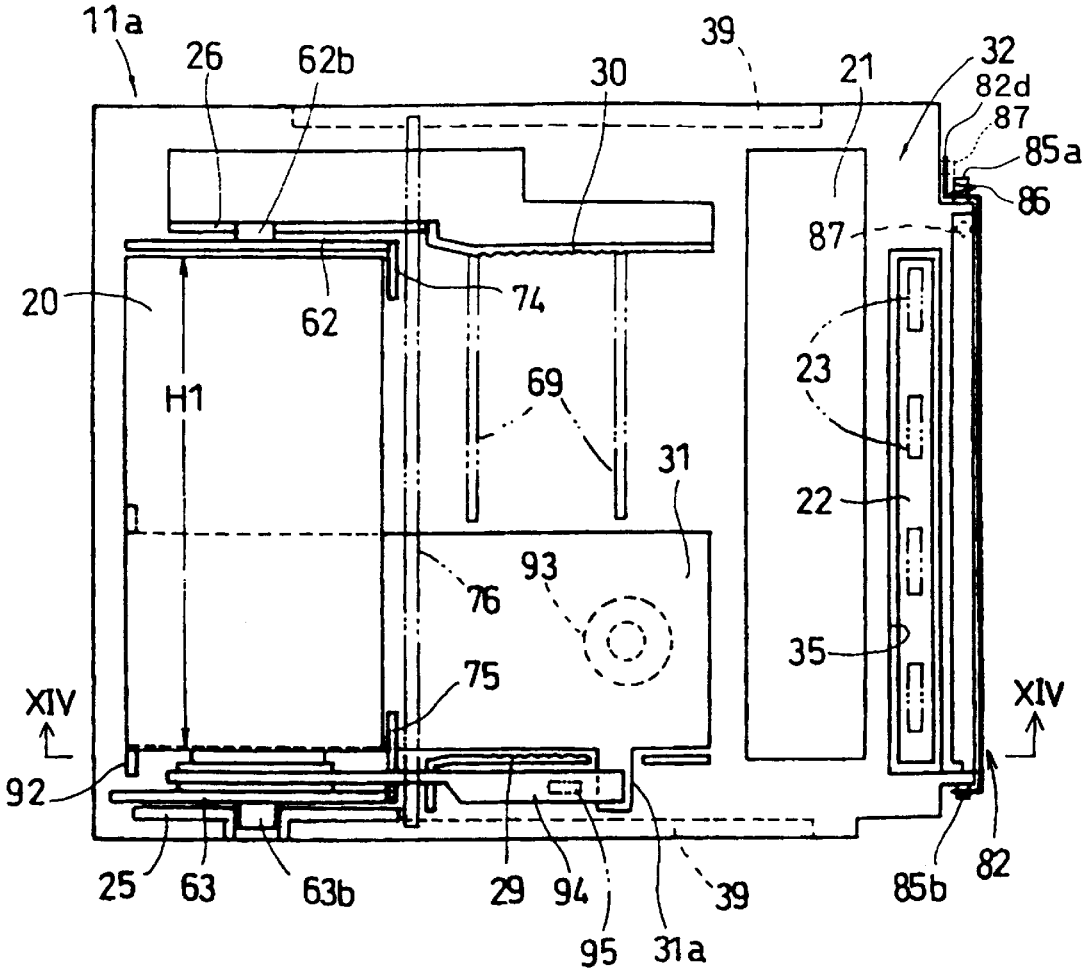
FIG. 8 is a plan view showing a lower case when an upper case has been removed according to the embodiment.

As shown in FIGS. 6 and 7, locking pawls 37 are rotatably disposed on the left and right sides of the nose portion 32 and can be pivoted moved outwardly. The locking pawls 37 have pawl portions 37*a*. Locking openings 38 are formed in the lower left and right sides of the flat portion 33. When the tops of the locking pawls 37 are rotated upwardly and inwardly as indicated by the solid lines in FIG. 7, pawl portions 37*a* engage the locking openings 38. Thus, the upper case 11*b* is fixed to the lower case 11*a*. When the tops of the locking pawls 37 are rotated outwardly as indicated by the broken lines in FIG. 7, the pawl portions 37*a* is disengaged from the locking openings 38. Thus, the upper case 11*b* can be opened with respect to the lower case 11*a*.

As shown in FIGS. 3, 4, 6, and 7, the guide grooves 39 are formed along the outer side surfaces of the nose portion 32, opening slightly wider near the front end of the web roll cassette 11, which end is inserted first into the frame body 2. Each of the guide grooves 39 includes a notched portion 40 formed as an opening in the lower side center of each guide groove 39, and a stop portion 41 near the rear end of the web roll cassette 11. The stop portions 41 are engageable with the rear cylindrical guide projections 46 of the guide frame 44. A locking spring 42 is fixed by a screw 43 to each side of the web roll cassette 11. The free end of the locking springs 42 press against the rear guide projections 46 for maintaining engagement between the stop portions 41 and the rear guide projections 46 as best shown in FIG. 4.

The distance between the front guide projections 45 and the rear guide projections 46 is set such that the front guide projections 45 is aligned with the notched portions 40 when the rear guide projections 46 are engaged by the stop portions 41. A leaf spring 47 (FIG. 3) is disposed on at least one guide frame 44 and in sliding contact with the guide groove 39 to restrain left and right movement of the web roll cassette 11.

Next, the construction of the pivot mechanism 24*b* will be described. The pivot mechanism 24*b* functions for selectively rotating the front discharging side of the web roll cassette 11 between an inclined insertion position along the guide projections 45 and 46 and a raised position along the web sheet D2 conveying path as shown by solid line and two dotted chain line in FIG. 4. A bracket 48 is disposed inside the frame body 2 and above a feed passage 59. A support frame 50 is mounted in the bracket 48 and is movable upward and downward. Each of the plurality of pinch rollers 23 is freely and rotatably supported on both ends by the support frame 50. The support frame 50 is urged downward by a coil spring 49. In the bracket 48, a limit switch 78 is provided for detecting a sheet nipping position or a setting position of the drive roller 22.

The elongated drive roller 22 for conveying the wide web sheet D2 or a cut sheet is disposed in opposition to the pinch rollers 23 on the lower side of the feed passage 59. The drive roller 22 is supported on a support arm 52. The support arm 52 is pivotably supported on a pivot shaft 51 extending from the frame body 2. The support arm 52 has a first engaging portion 52*a* extending downward from the drive roller 22, and a second engaging portion 52*b* integrally formed with the first engaging portion 52*a* and extending upward from near the pivot shaft 51 toward the front end of the upper case 11*b*.

An operation arm 54 is supported to a pivot shaft 55 rotatably extending from the frame body 2. The pivot shaft 55 has an irregular cross-section to provide a fixed connection to one end of the operation arm 54. Further, the lever 56 has a base end fixedly connected to the pivot shaft 55. Therefore, the pivotal movement of the lever 56 about an axis of the pivot shaft 55 provides a pivotal motion of the operation arm 54. A pressure roller 53 is provided at a free end of the operation arm 54. The pressure roller 53 is adapted to press onto the surface of the support arm 52. A locking device (not shown) is provided to lock a raised position of the lever 56, the raised position being shown by two dotted chain line in FIG. 4.

When the support arm 52 is rotated in the clockwise direction, the first engaging portion 52*a* engages with the lower front end of the nose portion 32 and lifts the front end of the web roll cassette 11 upward. When the support arm 52 rotates counterclockwise, the second engaging portion 52*b* engages with the front end bottom surface of the upper case 11*b* and pushes the front end of the web roll cassette 11 downward. This pivotal movement of the support arm 52 is provided by the manipulation of the lever 56.

Figure 9:
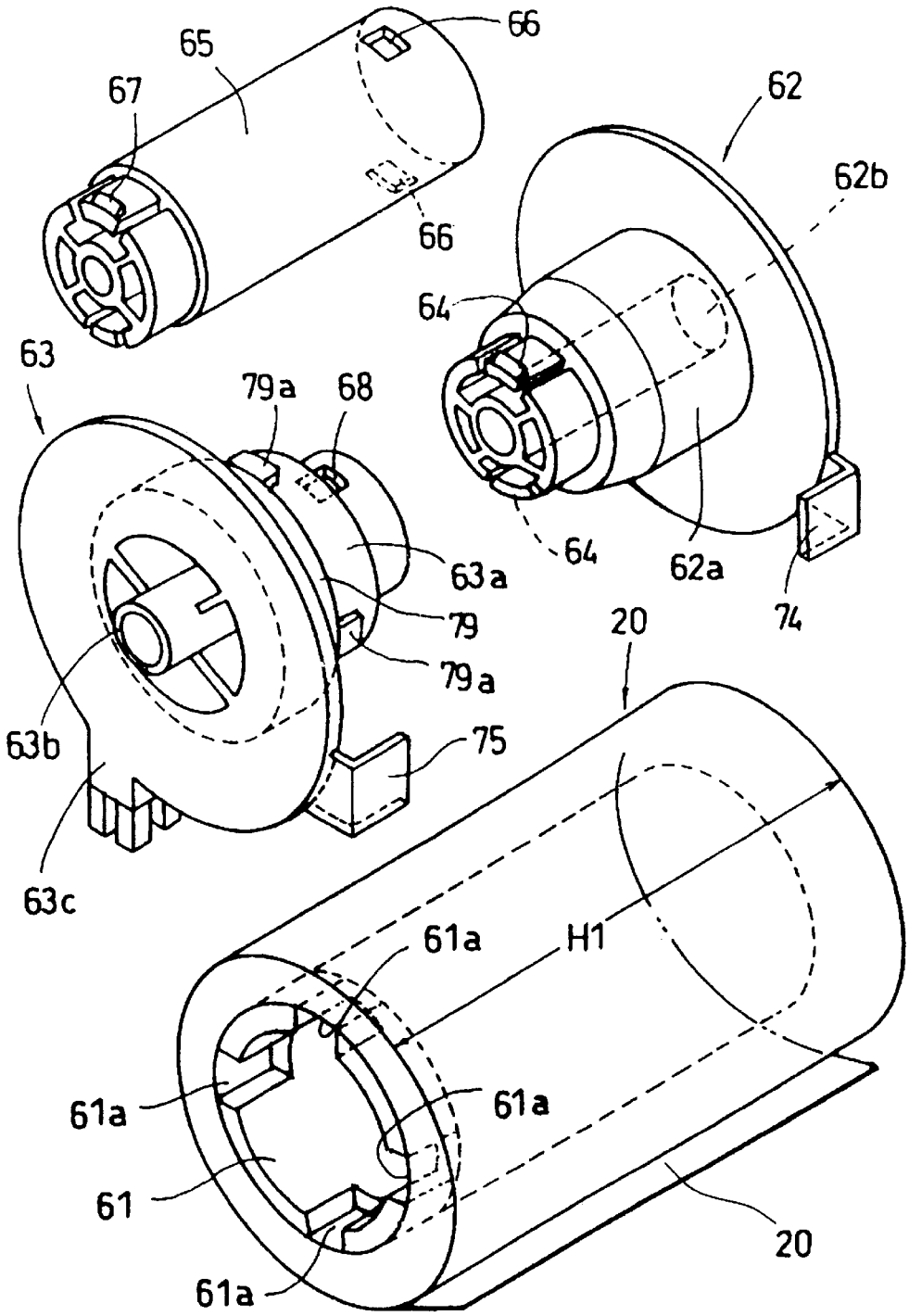
FIG. 9 is a segmental perspective view showing a web roll, left and right holders, and a connection tube according to the embodiment.

Next, a structure of the web roll 20 in the web roll cassette 11 will be described. As shown in FIG. 9, the web roll 20 having a width H1 is wrapped around a sheet tube 61, which functions as the core body. The web roll 20 is mounted on the left and right holders 62 and 63 such that the web roll 20 is rotatable and will not slip off the holders 62 and 63. An inner boss 62*a* is provided on the holder 62. A plurality of engaging pawls 64 is resiliently deformably disposed on the inner boss 62*a*. A connection tube 65 having a prescribed length fits into the sheet tube 61. A plurality of engaging holes 66 corresponding to the plurality of engaging pawls 64 are formed in one end of the connection tube 65. The plurality of engaging pawls 64 can engage with and disengage from the plurality of engaging holes 66. In addition, a plurality of engaging pawls 67 is resiliently deformably disposed on the other end of the connection tube 65. An inner boss 63*a* is disposed on the holder 63. A plurality of engaging holes 68 corresponding to the plurality of engaging pawls 67 are formed in the inner boss 63*a*. The plurality of engaging pawls 67 can engage with and disengage from the plurality of engaging holes 68.

The holders 62 and 63 disposed on the left and right ends of the web roll 20 via the connection tube 65 are positioned near the left and right ends of the web roll 20 and serve to protect these ends. Therefore, the length of the connection tube 65 should correspond to the width of the web roll 20. When the width of the web roll 20 is of a minimum size, the engaging pawls 64 on the inner boss 62*a* of the holder 62 should directly engage with the engaging holes 68 on the inner boss 63*a* of the holder 63 within the sheet tube 61.

A support boss 62*b* protrudes externally from the center portion of the holder 62 and is fitted from above into a support groove (not shown) that opens upwardly in the support portion 26 (FIG. 8). A support boss 63*b* protrudes outwardly from the center of the holder 63 and is fitted from above into a support groove (not shown) that opens upwardly in the support portion 25 (FIG. 8). This construction allows the web roll 20 to be replaced together with the holders 62 and 63. The support portion 26 and the side guide plate 30 described above are integrally formed and capable of moving sideways nearer or further in relation to the support portion 25 in order to correspond to the width H1 of the web roll 20. For this purpose, guide grooves 69 (FIG. 7) are formed in the bottom surface of the flat portion 33 in the upper case 11*b* in order to allow protruding guides (not shown) on the upper end of the side guide plate 30 to move in a horizontal direction across the guide grooves 69.

Figure 10:
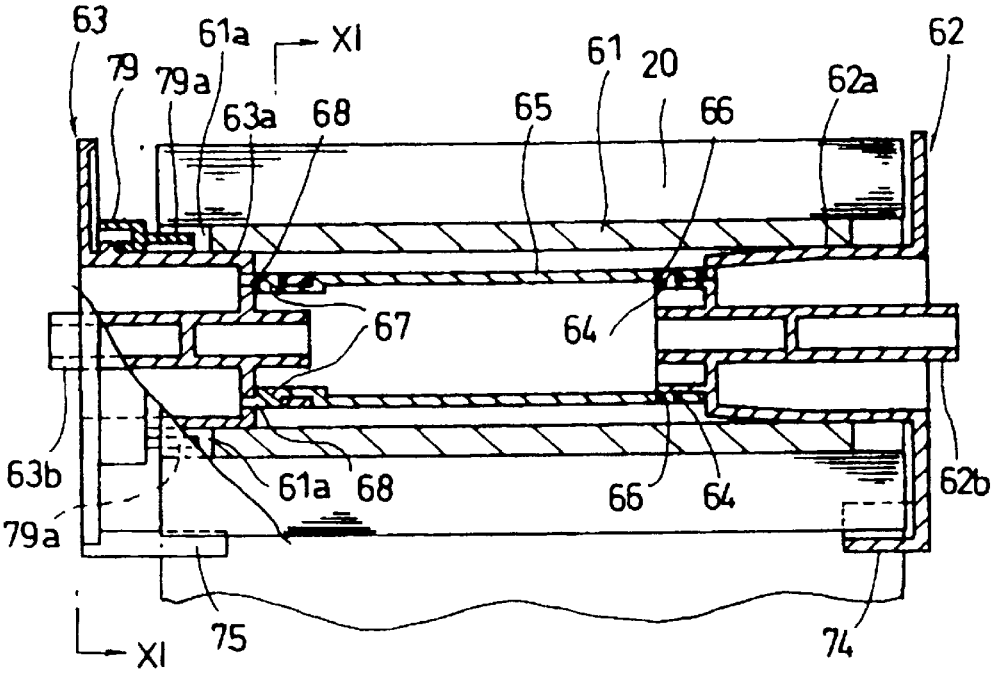
FIG. 10 is a cross-sectional view showing the state of the web roll mounted in the left and right holders according to the embodiment.
Figure 11:
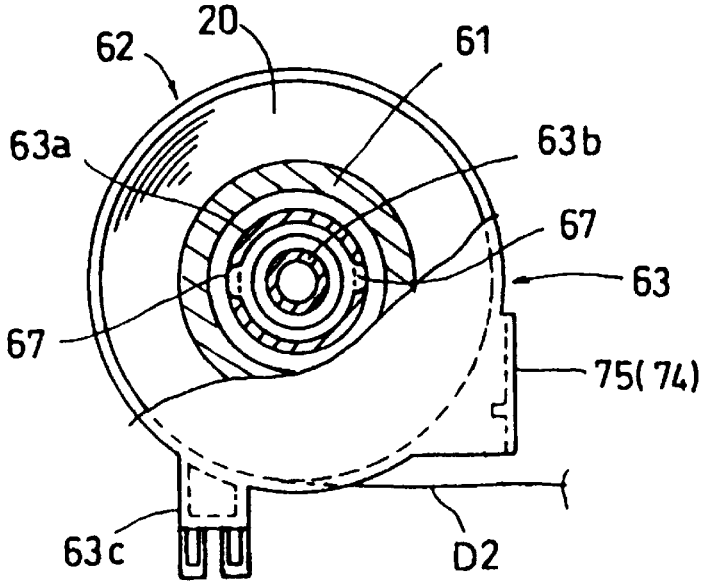
FIG. 11 is a partial cross-sectional view taken along the line XI—XI in FIG. 10.

As shown in FIGS. 9 and 10, a sleeve 79 having a large diameter is freely and rotatably fitted on the inner boss 63*a*. Engaging projections 79*a* are formed integrally on and protrude from the sleeve 79. A plurality of recessed portions 61*a* are formed in one side of the sheet tube 61 and correspond to the engaging projections 79*a*. The engaging projections 79*a* are fit into the recessed portions 61*a*. Thus, the web roll 20 is supported rotatably with respect to the holders. Near the support portion 26 (FIG. 8), a leaf spring shaped brake member 71 (FIG. 5) is fixed to the base of the lower case 11*a* via a screw 70 and contacts the outer surface of the sleeve 79 in order to prevent excessive rotations of the web roll 20.

For preventing the holders 62 and 63 from rotating, a sensor portion 63*c* is provided which protrudes externally in the radial direction on one side of the holder 63 and fits in an opening formed in a prescribed position in the lower case 11*a*. With this construction, the sensor portion 63*c* is exposed on the outside of the web roll cassette 11. As shown in FIG. 4, cassette detection switches 60 are disposed at prescribed locations on the frame body 2 so as to oppose the sensor portion 63*c* exposed from openings formed in prescribed locations in the lower case 11*a*. The sensor portion 63*c* has a specific projection/recess pattern indicative of kind and width of the web roll. Therefore, different projection/recess patterns are provided for different kind and width of the web roll. The cassette detection switches 60 are depressed by the projection pattern for recognizing the kind and width of the web roll.

In the accommodation space 27 of the upper case 11*b*, a plurality of unroll-preventing members 72 (FIG. 5) are provided for applying sliding pressure to the external surface of the web roll 20 via the urging force of a plurality of torsion springs 73. The brake member 71 and unroll-preventing member 72 apply a force to the web roll 20 to restrain excess rotations. Therefore, the brake member 71 and unroll-preventing member 72 not only prevent the web sheet D2 from becoming slack, but also apply a load against the conveying direction of the web sheet D2. As a result, the web sheet D2 can be conveyed in an appropriately taut condition for greater conveying accuracy.

At the right and left holders 62, 63, sheet regulation segments 74, 75 are provided for regulating the drawing out position of the web sheet D2 from the web roll 20 to the lower position of the holders 62, 63 in order to facilitate positioning of the web sheet D2 drawn out of the web roll 20 so that each lateral edge of the web sheet D2 can slide along each side guide plate 29, 30. More specifically, L shaped sheet regulation segments 74 and 75 protrude from one external side of the left and right holders 62 and 63, respectively, and are bent toward a longitudinal center of the web roll 20 to provide web regulating portions extending in an axial direction of the web roll.

The web regulating portions have sufficiently short lengths so as to avoid mechanical interference between the tip ends of the web regulating portions when the engaging pawls 64 on the inner boss 62*a* of the holder 62 is directly engaged with the engaging holes 68 of the inner boss 63*a* of the holder 63 in case a web roll of a minimum width is used.

When the holders 62, 63 holding the web roll 20 therebetween are mounted on the support portions 25, 26, respectively, the regulation plates 74, 75 are positioned at downstream side of the web roll 20 and at a lower portion of the holders 62, 63 as shown in FIG. 5. Further, the web roll 20 is held by the holders 62, 63 in such a manner that the leading end of the web is drawn out from the lower portion of the web roll 20. With this arrangement, the web drawn from the lower portion of the web roll 20 always passes below the lower edge of the regulation plates 74, 75 toward the platen 21.

This construction prevents the web sheet D2 from becoming loose on the web roll 20 and regulates feeding of the web sheet D2 to pass at a lower portions of the holders 62, 63. More specifically, in accordance with the printing operation, the diameter of the web roll 20 is gradually decreased. However, because of the provision of the regulation plates 74, 75, the passage of the web sheet is constantly maintained irrespective of the change in diameter of the web roll 20. In other words, a constant passage can be provided between the regulation segments 74, 75 and the front discharge side of the cassette 11 regardless of the change in diameter of the web roll 20. Further, because of the provision of the regulation segments 74, 75, the web sheet D2 unwound from the web roll 20 can be easily mounted such that the left and right edges of the web sheet D2 are positioned along the side guide plates 29 and 30 (FIG. 8). This improves feeding performance.

Furthermore, these regulation segments 74 and 75 interfere with the web sheet D2 if the web sheet D2 is pulled in an irregular path. More specifically, when the web sheet D2 is set so as to be drawn out from the upper periphery of the web roll 20, the web sheet D2 is first greatly bent at the lower edge of the regulating segments 74, 75 and then, when the upper case 11*b* is closed shut, is again greatly bent at the position of a guide rotation shaft 76 (described later). Therefore, even if the front edge of the web sheet D2 is drawn out to the position of a shutter 82 (FIG. 6, described later), when the upper case 11*b* is shut closed, the above-described bending action will greatly pull in the front edge of the web sheet backward.

As shown in FIGS. 5 and 8, the guide rotation shaft 76 is provided on the lower surface of the upper case 11*b* and slidingly contacts the web sheet D2 as the web sheet D2 passes over the surface of the platen 21 at the opening 34 and is expelled from the front end discharge portion of the web roll cassette 11 along the feed passage 59. The guide rotation shaft 76 is configured to pull the leading edge of the web sheet D2 back from the discharge end of the web roll cassette 11 when the upper case 11*b* is closed if the web sheet is improperly set around the regulation segments 74 75. Thus, the leading end of the web sheet D2 is moved past the guide rotation shaft 76 and passes over the platen 21 at the opening 34, and reaches the feed passage 59 through the front end discharge portion.

Figure 12:
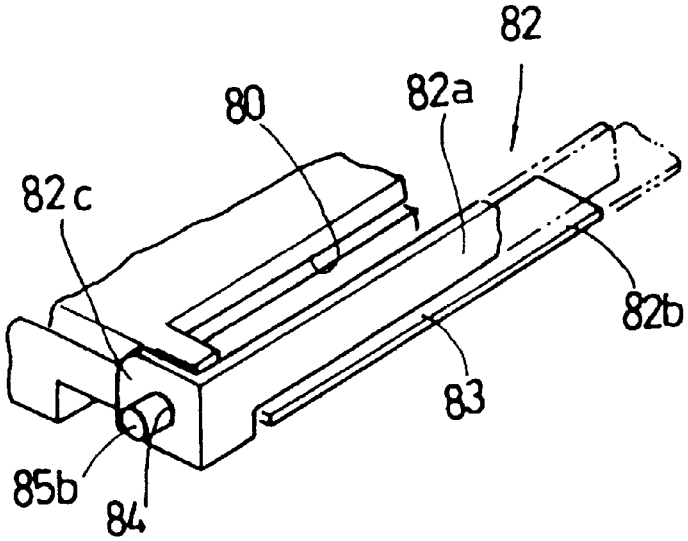
FIG. 12(*a*) is a partial perspective view showing a shutter in a closed state according to the embodiment.
Figure 12:
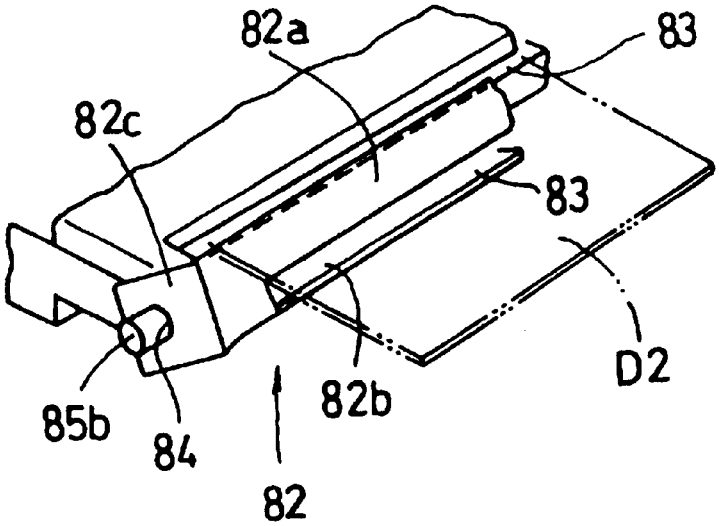
Figure 13:
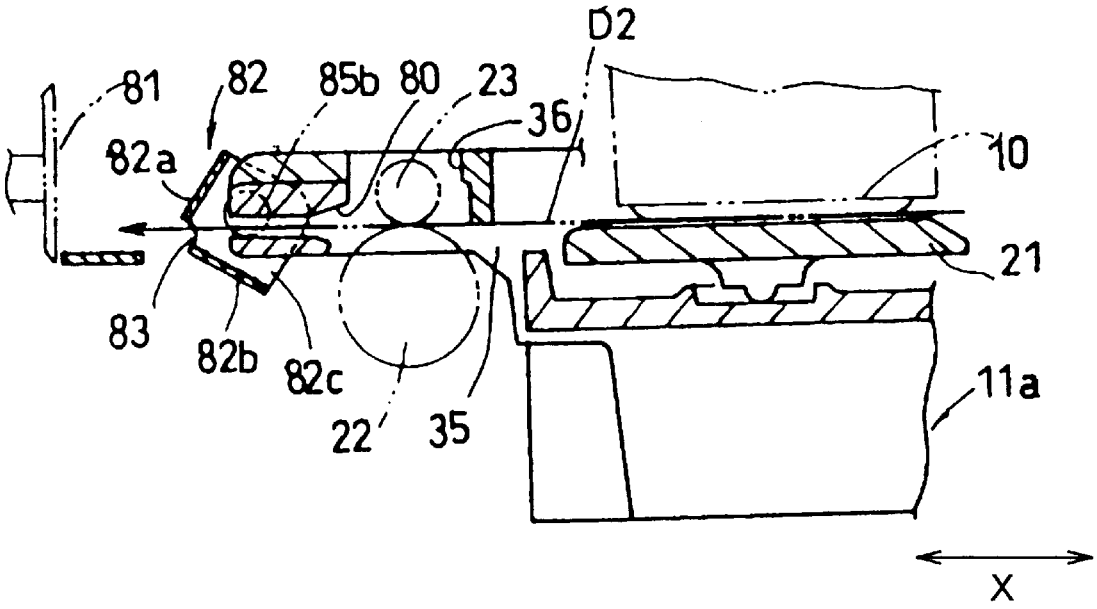
FIG. 13(*a*) is an enlarged side cross-sectional view showing the relative parts of the shutter in an open state.
Figure 13:
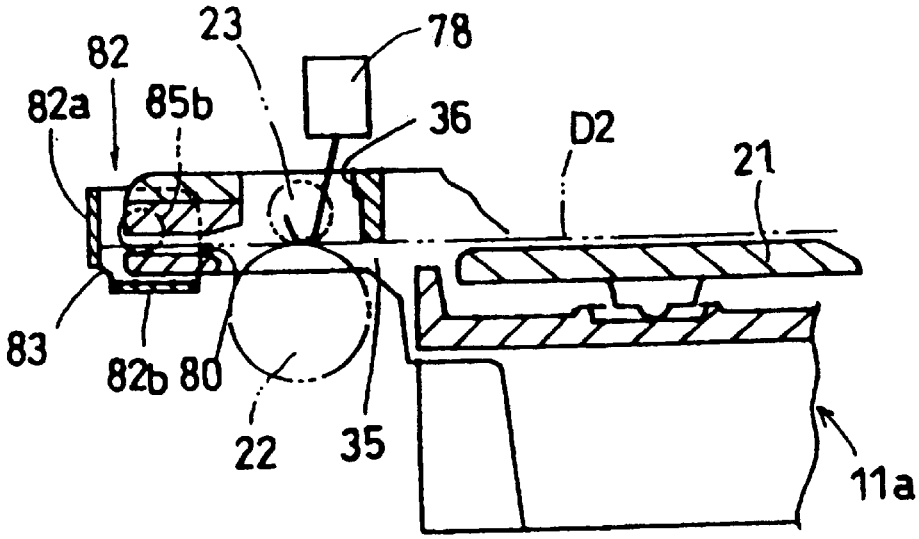

Next, the configuration for pulling the web sheet D2 from the web roll 20 will be described with reference to FIGS. 6, 8, 12(*a*), 12(*b*), 13(*a*) and 13(*b*). The shutter 82 is provided for opening and closing the passage 80 (FIG. 5) at the front end discharge portion of the web roll cassette 11. The shutter 82 has an L-shaped cross-section and has a vertical piece 82*a*, a bottom piece 82*b*, left and right side pieces 82*c* and an abutment piece 82*d*. An insertion slot 83 is formed horizontally between a lower edge of the vertical piece 82*a* and a front edge of the bottom piece 82*b*. Left and right side pieces 82*c* are formed integrally with the left and right sides of the vertical piece 82*a* and bottom piece 82*b*. The abutment piece 82*d* is connected to the vertical piece 82*a*. Shaft holes 84 are perforated through the left and right side pieces 82*c*. The shaft holes 84 are rotatably supported on left and right support shafts 85*a* and 85*b* extending from the lower case 11*a*. A torsion spring 86 (FIG. 6) is wrapped about the support shaft 85*a* and constantly applies a downward urging force on the shutter 82 to urge the insertion slot 83 out of alignment with the passage 80 so that the shutter 82 blocks the front of the passage 80, as shown in FIGS. 12(*a*) and 13(*b*). As shown in FIG. 13(*b*) the limit switch 78 extends into the through hole 36.

As shown in FIG. 8, a pressure member 87 protrudes downward from the inner surface of the frame body 2. When the front end discharge portion of the web roll cassette 11 is pivotally moved upward using the pivot mechanism 24*b* so that the discharge portion is in line with the feed passage 59, the pressure member 87 pushes against the top side of the abutment piece 82*d*. At this time, the shutter 82 is rotated such that the insertion slot 83 between the vertical piece 82*a* and the bottom piece 82*b* is in line with the passage 80 and the feed passage 59, as shown in FIGS. 12(*b*) and 13(*a*).

Next, a regulation mechanism will be described with reference to FIGS. 4 and 14 through 17. The regulation mechanism is adapted for enabling manual operation of the lever 56 with respect to the pivot mechanism 24*b* if the web roll cassette 11 is inserted into the insertion port 12 by a predetermined insertion length, and for disabling the pivotal operation of the lever 56 if the web roll cassette 11 is moved in the pulling out direction from the insertion port 12 by a predetermined length (the latter disabling state is also provided if the web roll cassette 11 is completely removed from the insertion port 12).

A chassis 88 is provided which supports the right and left guide frame 44. An abutment lever 89 is supported to the chassis 88. The abutment lever 89 includes a shaft portion 89*a* rotatably supported to the chassis 88, an abutment segment 89*b* connected to the shaft portion 89*a* and an operation segment 89*c* also connected to the shaft portion 89*a*. The abutment segment 89*b* has a free end to which the front end discharge portion of the web roll cassette 11 is abuttable when the web roll cassette 11 is inserted. Upon this abutment, the abutment segment 89*b* is pivotally moved about the shaft portion 89*a* so that the operation segment 89*c* is also pivotally moved. The operation segment 89*c* is formed with an elongated slot 89*d*.

The chassis 88 is formed with a plurality of guide grooves 88*a*, 88*b*, 88*b*, 88*c* extending in a direction perpendicular to the inserting direction (arrow A in FIGS. 15 and 16) of the web roll cassette 11. The chassis 88 has an upper surface from which a pair of guide bosses 88*e* protrude upwardly. A regulation member 90 formed of a synthetic resin is disposed upon the chassis 88 and is slidably movable with respect thereto. A plurality of guide pawls 90*a*, 90*b*, 90*b* protrude downwardly from the lower surface of the regulation member 90, and unreleasably engage the plurality of guide grooves 88*a*, 88*b*, 88*b*, respectively. The regulation member 90 has a lower surface formed with an elongated groove 90*e* extending in parallel with the guide grooves 88*a*, 88*b*, 88*b*. The pair of guide bosses 88*e* are slidably engaged with the elongated groove 90*e* for facilitating linear and smooth movement of the regulation member 90 relative to the chassis 88.

Figure 14:
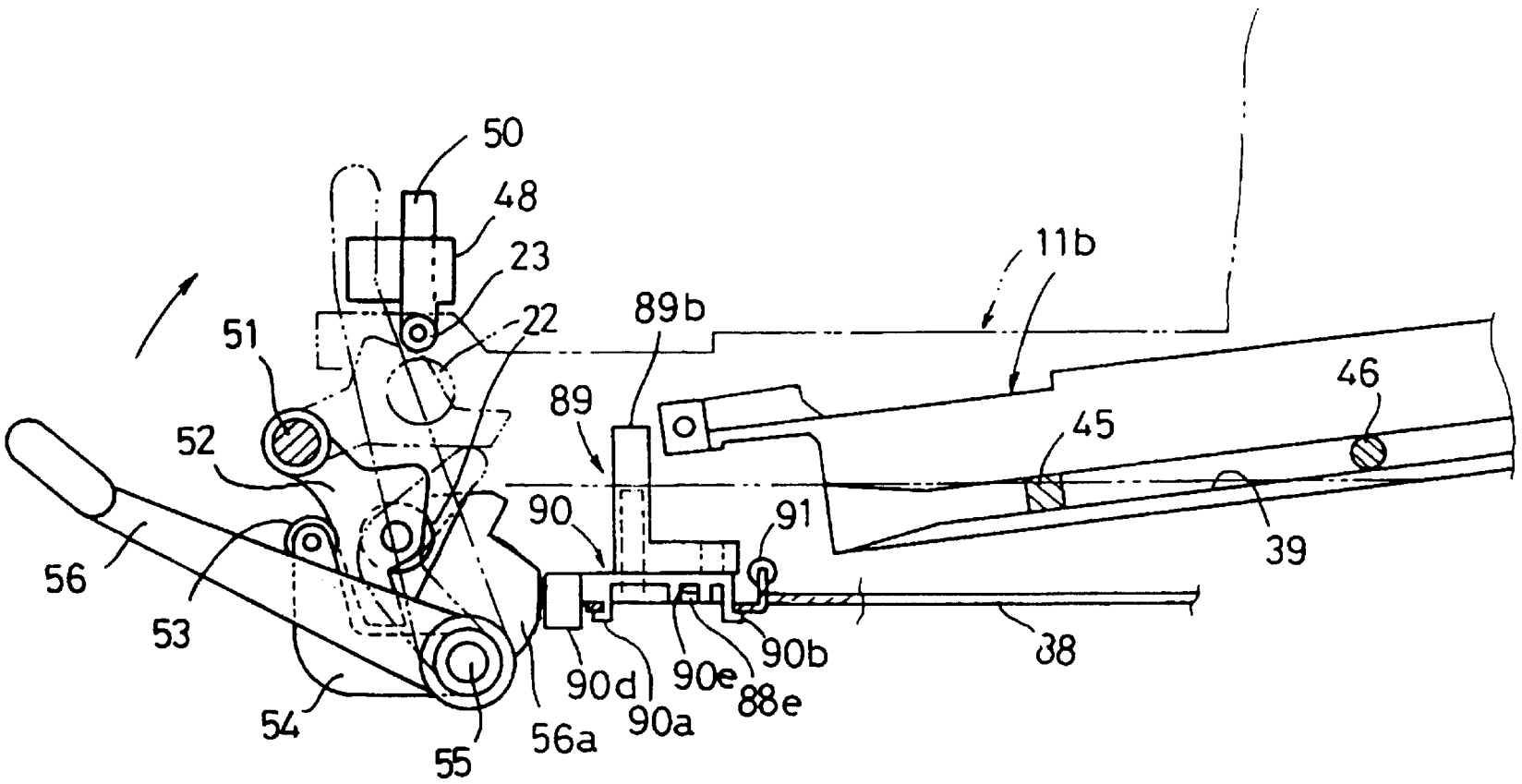
FIG. 14 is a side view particularly showing a regulation mechanism for preventing a pivot mechanism from being manipulated according to the embodiment of this invention.
Figure 15:
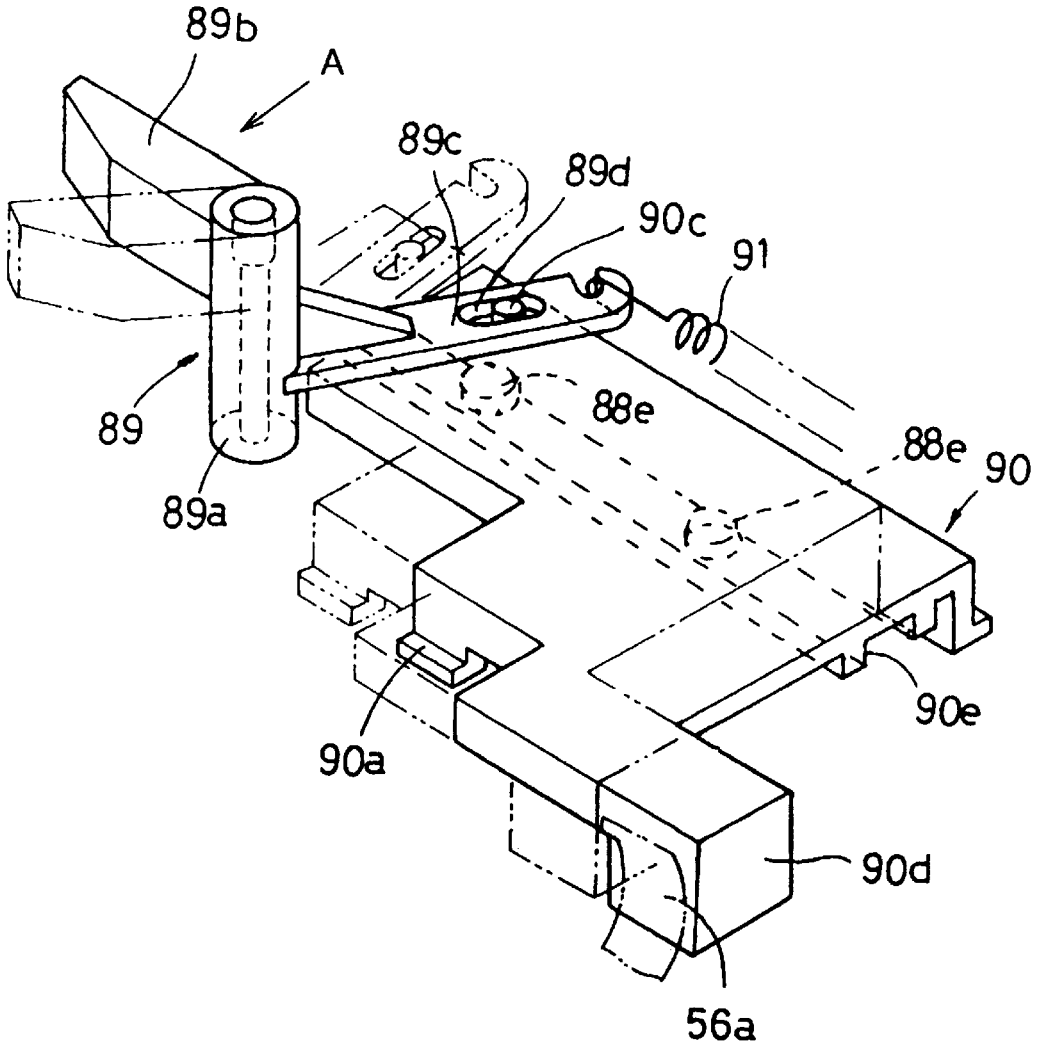
FIG. 15 is a segmental perspective view showing an essential portion of the regulation mechanism.

The regulation member 90 has an upper surface provided with an engagement pin 90*c* slidably engaged with the elongated slot 89*d*. The chassis 88 has a hook portion 88*d*, and a tension spring 91 is hooked between the hook portion 88*d* and the operation segment 89*c* for normally urging operation segment 89*c* in a clockwise direction in FIG. 15. Thus, by the tension spring 91, the regulation member 90 is biased in a direction away from the side of the guide frame 44 (rightwardly in FIG. 15). Further, the regulation member 90 integrally provides a regulation block 90*d* protruding downwardly. The regulation block 90*d* is engageable with the guide groove 88*c* when the regulation member 90 is moved toward the guide frame 44. The lever 56 integrally provides an eccentric block portion 56*a* at a pivotal base portion thereof. Therefore, the eccentric block portion 56*b* is moved by the pivotal movement of the lever 56. When the regulation member 90 is moved to the solid line position in FIG. 15 by the biasing force of the tension spring 91, the regulation block 90*d* closely confronts the eccentric block portion 56*b* as shown in FIG. 14. In this state, pivotal movement of the lever 56 in the clockwise direction in FIG. 14 is prevented because of the face to face relation between the eccentric block portion 56*b* and the regulation block 90*d*.

Figure 16:
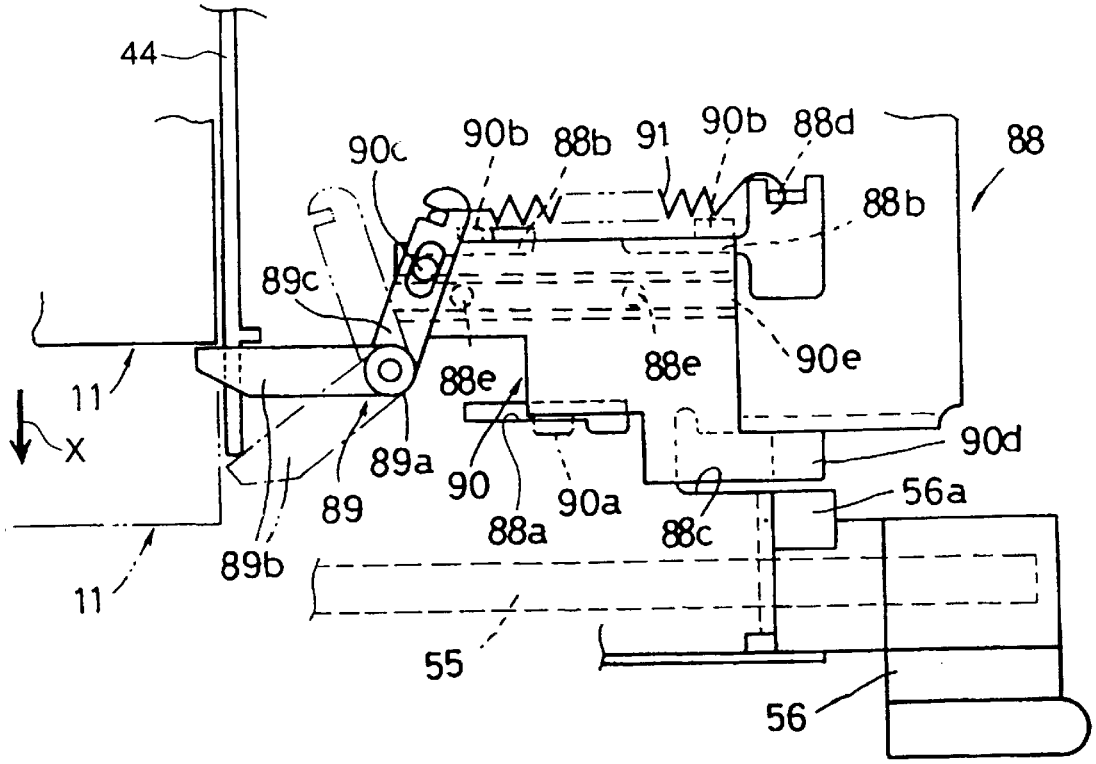
FIG. 16 is a plan view showing a state where the manipulation of the pivot mechanism is prevented upon movement of the regulation mechanism to its regulation position.

As shown by two dotted chain line in FIG. 16, if the web roll cassette 11 is inserted through the insertion port 12 and if the front end discharge portion of the web roll cassette 11 presses the abutment segment 89*b*, the abutment segment 89*b* is pivotally moved in a counterclockwise direction in FIG. 16, so that the operation segment 89*c* is pivotally moved to the two dotted line position in FIG. 16 against the biasing force of the tension spring 91. Thus, the regulation member 17 is forcibly moved by way of the engagement between the engagement pin 90*c* and the elongated slot 89*d* to a solid line position in FIG. 17. In this state, the regulation block 90*d* is moved into the groove 88*c* where the regulation block 90*d* is positioned offset from the eccentric block 56*d*. As a result, the lever 56 can be pivotally moved in the clockwise direction in FIG. 14 because mechanical interference with the regulation block 90*d* does not occur.

Next, operations for mounting and determining the position of the web roll 20 in the web roll cassette 11, and operations for mounting and detaching the web roll cassette 11 in relation to the printer 1 will be described.

The web sheet D2 is pulled as far as the front end discharge portion of the web roll cassette 11. With maintaining the closing state of the upper case 11*b*, as shown in FIGS. 2 and 3, the front end discharge portion is inserted through the insertion port 12 and between the guide frames 44 and 44. At this time, as shown by the solid line in FIG. 4, the front end discharge portion is sloped slightly downward, and the rear guide projections 46 and front guide projections 45 protruding from the inner surfaces of the guide frames 44 are inserted in order into the front open ends of the guide grooves 39.

Figure 17:
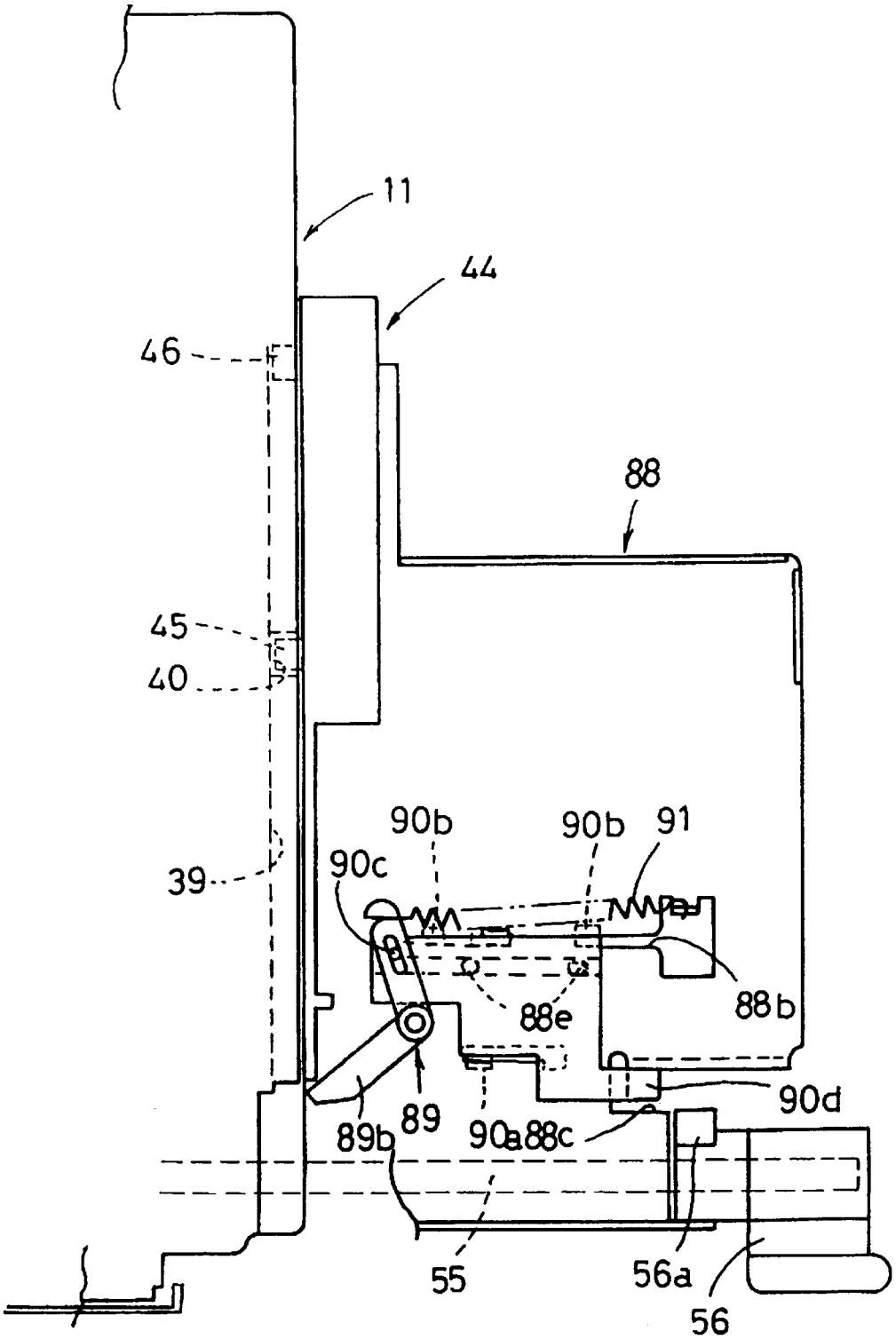
FIG. 17 is a plan view showing a state where the manipulation of the pivot mechanism can be performed upon movement of the regulation mechanism to its regulation-release position.

Accordingly, as shown in FIG. 14, if the web roll cassette 11 is inserted by a predetermined length in a downwardly slanted posture, the abutment lever 89 is pivotally moved in a predetermined direction (counterclockwise direction in FIGS. 16 and 17). Therefore the regulation block 90*d* of the regulation member 90 is moved to the position beside the eccentric block 56*a*, where the regulation block 90*d* does not interfere the eccentric block 56*a*. Accordingly, pivotal movement of the lever 56 can be achieved.

When the stop portions 41 at the rear of the guide grooves 39 abuts the rear guide projections 46, the top surfaces of the rear guide projections 46 are resiliently engaged by the locking springs 42. When the rear guide projections 46 are engaged with the stop portions 41, the front guide projections 45 are positioned in opposition to the notched portions 40, and the front end discharge portion is positioned opposing the top position of the drive roller 22.

Then, when the lever 56 is pivotally moved in the counterclockwise direction in FIG. 4, the support arm 52 rotates in the clockwise direction via the pressure roller 53 mounted on the operation arm 54. This rotation causes the first engaging portion 52*a* on the support arm 52 to press up against the front end discharge portion of the web roll cassette 11. At this time, the front end discharge portion is pivotally moved in counterclockwise direction around the cylindrical rear guide projections 46. The front notched portions 40 formed in the lower central sides of the guide grooves 39 are fit around the guide projections 45. Therefore, the web roll cassette 11 is locked in the frontward/rearward direction. The lever 56 is fixed in the raised position by the locking device (not shown).

The limit switch 78 provided in the bracket 48 as shown in FIGS. 4 and 13(*b*) detects the setting state of the drive roller 22. Further, a leading edge of the web sheet D2 is detected by another sensor such as a limit switch (not shown). In this state, as indicated by the broken lines in FIG. 4, the platen 21, on which the web sheet D2 is positioned, opposes and is near to the thermal head 10 in the printing unit. Further, the leading edge of the web sheet D2 is positioned at the front end discharge portion and is nipped between the pinch roller 23 and the drive roller 22. Hence, the web sheet D2 can be conveyed.

When the front end discharge portion is set in line with the feed passage 59, i.e., when the front end discharge portion of the web roll cassette 11 is raised until the web roll cassette 11 is prevented from moving forward and backward, the sensor portion 63*c* press against and activate the cassette detection switches 60. When activated, these cassette detection switches 60 determine the position of the web roll cassette 11 and detect the width and type of the web roll 20.

In this state, as shown by the two dotted chain line in FIG. 4, the platen 21 on which the web sheet D2 is mounted is positioned close to and in confrontation with the thermal head 10. Further, the web sheet D2 at the front end discharge portion is nipped between the pinch roller 23 and the drive roller 22. With this state, printing operation is performed onto the web sheet D2 with the thermal head 10 being moved in the direction Y (FIG. 2) perpendicular to the direction X which is the feeding direction of the web sheet D2.

During printing operation if a sheet jamming occurs, the user pivotally moves the lever 56 in the clockwise direction in FIG. 4, so that the support arm 52 is pivotally moved in the counterclockwise direction about the pivot shaft 51 by the weight of the cassette 11 and the weight of the drive roller 22 supported to the support arm 52. Accordingly, the front end discharge portion of the web roll cassette 11 is no longer supported by the first engaging portion 52*a*, and therefore, the front end discharge portion of the web roll cassette 11 is pivotally moved downwardly about the rear guide projection 46. This action separates the pinch roller 23 from the drive roller 22, releasing the web sheet D2. At this time, the front guide projections 45 are now out of the notched portions 40 and back in the middle of the guide grooves 39. Therefore, the jammed web sheet D2 can be easily released after removing the web roll cassette 11 from the insertion port 12. That is, relatively wide open space can be provided around the sheet feed passage in the printer after removal of the cassette 11 from the printer 1.

In this way, the web roll cassette 11 can only be mounted in or detached from the frame body 2 when the front end discharge portion is sloped downward. This is advantageous in protecting the printing unit. That is, if sheet jamming occurs at the printing unit, and if the web roll cassette 11 can be removed without changing its inclination, the rearward movement of the web roll cassette 11 may damage to the printing unit due to the jamming sheet. In the illustrated embodiment, because the web roll cassette 11 cannot be removed while maintaining its horizontal posture because of the mechanical abutment between the recess 40 and the front guide projection 45, but the cassette 11 can only be removed when the web roll cassette 11 is sloped down, a wide open space can be provided at the printing unit, so that the printing unit can be protected against the jamming sheet.

Further, as long as the web roll cassette 11 is not inserted by the predetermined length, the regulation member 90 is not moved to the regulation-free position. In this state, since the lever 56 cannot be manually moved, the collision of the front end discharge portion against the drive roller 22 due to the erroneous pivotal movement of the lever 56 can be prevented. Thus, it is possible to avoid damage to the front end discharge portion of the web roll cassette 11.

While the invention has been described in detail and with reference to the specific embodiments thereof, it would be apparent to those skilled in the art that various changes and modifications may be made therein without departing from the spirit and scope of the invention.

For example, in the depicted embodiment, the drive roller 22 and the associated pivot mechanism 24*b* are positioned below the sheet feed passage 59, and the pinch roller 23 is positioned above the sheet feed passage 59. However, the relative positions can be reversed such that the drive roller 22 and the pivot mechanism 24*b* are positioned above the sheet feed passage 59 and the pinch roller 23 is positioned therebelow. In the latter case, a notched portion 40 can be formed in the upper area of the guide groove 39 so that operation for installing and detaching the web roll cassette 11 are possible only when the front end discharge portion of the web roll cassette 11 is in an upward slanting posture.

Further, in the depicted embodiment, the front and rear guide projections 45 and 46 are provided at the guide frame 44 of the frame body 2, and the corresponding guide grooves 39 are formed at the sides of the web roll cassette 11. However, the guide projections 45 and 46 can be provided at the side of the web roll cassette, and the guide grooves opening to the insertion port 12 can be formed in the guide frame 44. In the latter case, a notched portion can be formed at an upper area of a deep end of the guide groove, so that the notched portion is in alignment with the front guide projection 45 when the front end discharge opening of the web roll cassette is pivotally moved upwardly. Further, the printing unit of the present invention is not limited to a thermal head type printing unit, but can also be an inkjet type printing unit.

Further, in the depicted embodiment, the image recording device uses the web-roll and the web roll cassette for printing an image on the web roll sheet. However, instead of the web-roll and the web roll cassette, ordinary cut sheets and cut-sheets cassette are available by suitably modifying the cassette accommodating portion in the image recording device.

What is claimed is:

1. An image recording device for forming an image on a sheet, the sheet being accommodated in a cassette and discharged from a front end discharge portion of the cassette, the image recording device comprising:

a frame body provided with a cassette insertion port, a cassette accommodating portion, and a sheet passage extending from the cassette accommodating portion in a sheet feeding direction, the cassette being detachably mounted in the cassette accommodating portion through the cassette insertion port, the cassette accommodating portion having a guide member that guides the cassette in a predetermined orientation;

a sheet feed unit that nips the sheet at the front end discharge portion and feeds the sheet in the sheet feeding direction along the sheet passage, the sheet feed unit comprising a drive roller and a pinch roller for nipping therebetween the sheet;

a printing unit that prints the image on the sheet fed by the sheet feed unit;

a pivot mechanism comprising: a lever movable between a nipping position where the drive roller and the pinch roller are relatively moved toward each other for nipping the sheet and a release position where the drive roller and the pinch roller are relatively moved away from each other; and a support portion pivotally movable upon pivotal movement of the lever, one of the drive roller and the pinch roller being supported by the support portion and the remaining one of the pinch roller and the drive roller being supported on the frame body; and a regulation mechanism that prevents the lever from pivotally moving toward the nipping position until the front end discharge portion reaches a predetermined position in accordance with the insertion of the cassette relative to the guide member.

2. The image recording device as claimed in claim 1, wherein the sheet is a web sheet in a web-roll form, and the cassette comprises a web-roll cassette, the web sheet being unwindingly discharged from the front end discharge portion of the web roll cassette, the cassette insertion port, the cassette accommodating portion, and the sheet passage serving as a web roll cassette insertion port, a web roll cassette accommodating portion, and a web sheet passage, respectively.

3. The image recording device as claimed in claim 2, wherein the regulation mechanism comprises:

a regulation member movable between a regulating position and a non-regulating position, the lever being in a mechanically interfering position with the regulation member when the regulation member is moved to the regulating position;

a biasing member that biases the regulation member toward the regulating position; and an abutment lever to which the front end discharge portion of the web roll cassette is abutable at the predetermined position, the abutment lever being connected to the regulation member for moving the regulation member toward the non-regulating position upon the abutment lever being pushed by the front end discharge portion.

4. The image forming device as claimed in claim 3, wherein the frame body further comprises a chassis which supports the guide member.

5. The image forming device as claimed in claim 4, wherein the pivot mechanism further comprises a block portion provided to the lever;

and wherein the regulation member has a regulation block in mechanically interfering relation to the block portion when the regulation member is moved to the regulating position.

6. The image forming device as claimed in claim 5, wherein the abutment lever comprises a shaft portion rotatably supported to the chassis;

an abutment segment fixed to the shaft portion and extending into the sheet feed passage defined by the guide member, the front end discharge portion being abutable against the abutment segment; and an operation segment fixed to the shaft portion and connected to the regulation member; the biasing member being provided between the operation segment and the chassis, the pivotal movement of the abutment segment being translated into a linear movement of the regulation member.

7. The image forming device as claimed in claim 6, wherein the regulation member is slidable upon the chassis, and wherein the chassis is formed with at least one guide groove extending in a direction perpendicular to the sheet feeding direction, and wherein the regulation member further comprises at least one guide pawl engageable with the guide groove for guiding the linear movement of the regulation member.

8. The image forming device as claimed in claim 6, wherein the regulation member is slidable on the chassis, and wherein the chassis has an upper surface provided with a guide boss protruding upwardly;

and wherein the regulation member has a lower surface formed with an elongated groove with which the guide boss is engageable for guiding the linear movement of the regulation member.

9. The image forming device as claimed in claim 2, wherein the web roll cassette comprises a case accommodating therein a web roll from which the web sheet is unwound in the sheet feeding direction, the web roll cassette having the front end discharge portion directing toward the web sheet passage, the case being formed with a through hole at a position adjacent the front end discharge portion, the drive roller being positioned at the through hole in contactable with one surface of the web sheet, and the pinch roller being positioned at the through hole in contactable with an opposite surface of the web sheet during printing operation.

10. The image recording device as claimed in claim 9, wherein the web roll cassette further comprises a platen positioned upstream of the through hole and confrontable with the printing unit when the web roll cassette is installed in the web roll cassette accommodating portion.

11. The image recording device as claimed in claim 2, wherein the web roll cassette has a pair of side ends each in confrontable relation with each guide member when the web roll cassette is inserted into the web roll accommodating portion;

and the image recording device further comprising:

a front guide projection and a rear guide projection positioned upstream of the front guide projection in the sheet feeding direction, the front and rear guide projections protruding, in a direction perpendicular to the sheet feeding direction, from one of the pair of side ends of the web roll cassette and the guide member;

a guided member having a groove slidingly engageble in the pair of front and rear guide projections when the web roll cassette is installed into the web roll accommodating portion through the insertion port, the guided member being provided at a remaining one of the pair of side ends and the guide member, the engagement between the front and rear guide projections and the groove defining an inserting position of the web roll cassette;

and wherein the pivot mechanism is provided in the web roll accommodating portion for pivotally moving, about the rear guide projection, the web roll cassette so that the front end discharge portion of the web roll cassette is moved from the inserting position toward the web sheet passage and into an operating position.

12. The image recording device as claimed in claim 11, wherein the guided member is formed with a notched portion at a position in alignment with the front guide projection, the front guide projection being engaged with the notched portion when the web roll cassette is pivotally moved to the operating position, whereby the web roll cassette is locked at the operating position.

13. The image recording device as claimed in claim 12, wherein the guided member has a rear end provided with a stop portion abutable against the rear guide projection when the web roll cassette is inserted into the web roll cassette accommodating portion;

and wherein the web roll cassette further comprises a locking spring engageable with the rear guide projection when the stop portion engages the rear guide projection whereby the web roll cassette is pivotally movable about the rear guide projection.

14. The image recording device as claimed in claim 13, wherein the drive roller is rotatably supported on the pivot mechanism, whereby the drive roller is moved toward the web sheet when the web roll cassette is pivotally moved from the inserting position to the operating position, and is moved away from the web sheet when the web roll cassette is pivotally moved from the operating position to the inserting position.

15. The image recording device as claimed in claim 1, wherein when the cassette is mounted in the cassette accommodating portion, the front end discharge portion of the cassette is interposed between the drive roller and the pinch roller.

16. The image recording device as claimed in claim 1, wherein the support portion is positioned in direct abutment with the cassette and pivotally moves the cassette to an operable position when the cassette is inserted into a predetermined position, the support portion being concurrently moved when the lever is moved to the nipping position.

17. The image recording device as claimed in claim 1, wherein a lever opening is provided in the frame body, and the lever protrudes from the opening so as to be externally manually operable.

18. An image recording device for forming an image on a web sheet unwound from a web roll comprising:

a frame body formed with a cassette insertion port, a cassette accommodating portion, and a feed passage positioned downstream of the cassette accommodating portion;

a sheet feed unit for feeding the web sheet along the feed passage in a feeding direction, the sheet feed unit feeding the web sheet in the sheet feeding direction along the web sheet passage, the sheet feed unit comprising a drive roller and a pinch roller for nipping therebetween the web sheet;

a printing unit for printing an image on the web sheet;

a front guide projection protruding from the cassette accommodating portion;

a rear guide projection protruding from the cassette accommodating portion and at a position higher than the front guide projection;

a pivot mechanism for pivotally moving the web roll cassette between an operating position in horizontal alignment with the rear guide projection and a slanted inserting position, the pivot mechanism comprising: a lever movable between a nipping position where the drive roller and the pinch roller are relatively moved toward each other for nipping the web sheet and a release position where the drive roller and the pinch roller are relatively moved away from each other; and a support portion pivotally movable upon pivotal movement of the lever, one of the drive roller and the pinch roller being supported by the support portion and the remaining one of the pinch roller and the drive roller being supported on the frame body;

a web roll cassette housing therein the web roll serving as an image recording medium, the web roll cassette comprising:

a lower case having one side and another side;

an upper case supported on the lower case and having one side and another side, the upper and lower cases selectively providing an opening state and a closing state and defining therein an accommodation space at the one side for accommodating therein the web roll in the closing state, and a front end discharge portion being formed at the another side of the upper and lower cases in the closing state the front end discharge portion being engageable with the pivot mechanism, the sheet feed unit nipping the web sheet at the front end discharge portion, and a platen provided at a position upstream of the front discharge portion in the feeding direction, the platen being confrontable with the printing unit, and through holes being formed in the upper and lower cases at a position between the front discharge portion and the platen for allowing the feeding unit to be positioned in the through holes, a guide groove being formed at a lateral side of the lower case for engaging with the front and rear guide projections; and a regulation mechanism that prevents the lever from pivotally moving toward the nipping position until the front end discharge portion reaches a predetermined position in accordance with the insertion of the web roll cassette relative to the guide member.

19. The image recording device as claimed in claim 18, wherein the regulation mechanism comprises:

a regulation member movable between a regulating position and a non-regulating position, the lever being in mechanically interfering position with the regulation member when the regulation member is moved to the regulating position;

a biasing member that biases the regulation member toward the regulating position; and an abutment lever to which the front end discharge portion of the web roll cassette is abutable at the predetermined position, the abutment lever being connected to the regulation member for moving the regulation member toward the non-regulating position upon the abutment lever being pushed by the front end discharge portion.

20. The image forming device as claimed in claim 19, wherein the frame body further comprises a chassis which supports the guide member.

21. The image forming device as claimed in claim 20, wherein the pivot mechanism further comprises a block portion provided to the lever;

and wherein the regulation member has a regulation block in mechanically interfering relation to the block portion when the regulation member is moved to the regulating position, and wherein the abutment member comprises:

a shaft portion rotatably supported to the chassis;

an abutment segment fixed to the shaft portion and extending into the sheet feed passage defined by the guide member, the front end discharge portion being abutable against the abutment segment; and an operation segment fixed to the shaft portion and connected to the regulation member; the biasing member being provided between the operation segment and the chassis, the pivotal movement of the abutment segment being translated into a linear movement of the regulation member.

22. The image forming device as claimed in claim 21, wherein the regulation member is slidable upon the chassis, and wherein the chassis is formed with at least one guide groove extending in a direction perpendicular to the sheet feeding direction, and wherein the regulation member further comprises at least one guide pawl engageable with the guide groove for guiding the linear movement of the regulation member.

23. The image forming device as claimed in claim 21, wherein the regulation member is slidable on the chassis, and wherein the chassis has an upper surface provided with a guide boss protruding upwardly;

and wherein the regulation member has a lower surface formed with an elongated groove with which the guide boss is engageable for guiding the linear movement of the regulation member.

24. The image recording device as claimed in claim 18, wherein the web roll cassette further comprises a stop portion engageable with the rear guide projection, a notched portion being formed at the guide groove for engagement with the front guide projection to maintain the operating position.

* * * * *